US005914693A

United States Patent [19]

Takei et al.

[11] Patent Number: 5,914,693

[45] Date of Patent: Jun. 22, 1999

[54] COAXIAL RESONANT SLOT ANTENNA, A METHOD OF MANUFACTURING THEREOF, AND A RADIO TERMINAL

[75] Inventors: Ken Takei, Hachioji; Mikio Kuwahara, Yokohama; Hiroshi Okabe, Kokubunji; Hiroshi Kishida, Hachioji; Kazuyuki Hori, Tokyo; Yoshitaka Imakado, Hitachinaka; Tomonori Nomura, Yokohama, all of Japan

[73] Assignee: Hitachi, Ltd., Tokyo, Japan

[21] Appl. No.: 08/708,563

[22] Filed: Sep. 5, 1996

[30] Foreign Application Priority Data

Sep. 5, 1995 [JP] Japan ..... 7-227959
Sep. 20, 1995 [JP] Japan ..... 7-241305

[51] Int. Cl.[6] ..... H01Q 13/10

[52] U.S. Cl. ..... 343/767; 343/700 MS; 343/771

[58] Field of Search ..... 343/771, 767, 343/830, 770, 702, 700 MS, 769, 746

[56] References Cited

U.S. PATENT DOCUMENTS

| | | | |
|---|---|---|---|
| 3,599,187 | 8/1971 | Bobeck | 340/174 CH |
| 4,063,246 | 12/1977 | Greiser | 343/700 MS |
| 4,197,545 | 4/1980 | Favaloro | 343/700 MS |
| 4,494,083 | 1/1985 | Josefsson et al. | 333/33 |
| 4,724,443 | 2/1988 | Nysen | 343/700 MS |
| 5,231,407 | 7/1993 | McGirr et al. | 343/700 MS |
| 5,337,065 | 8/1994 | Bonnet et al. | 343/767 |

FOREIGN PATENT DOCUMENTS

| | | |
|---|---|---|
| 5-14047 | 1/1993 | Japan . |
| 5-327331 | 12/1993 | Japan . |
| 6-177629 | 6/1994 | Japan . |

*Primary Examiner*—Michael Tokar
*Assistant Examiner*—Qui Van Duong
*Attorney, Agent, or Firm*—Antonelli, Terry, Stout & Kraus, LLP

[57] ABSTRACT

A coaxial resonant slot antenna having a novel structure is provided to further reduce the dimensions of radio terminals incorporating such an antenna. Also provided are a novel method of fabricating such a coaxial resonant slot antenna and a radio terminal having a novel structure using such a coaxial resonant slot antenna. An entire strip conductor is arranged inside a flat conductive cubic such that the strip conductor is insulated from the conductive cubic. A connection point between the strip conductor and a radio frequency transmission line is provided at a position about ¼ of wavelength away from one end of the strip conductor. A slot is shaped into a narrow rectangle, a generally upside-down "U", or a generally upside-down "U" having another slot on each end. It is desired that the center slot crosses the strip conductor along the length thereof and in the height direction thereof, the distance between the ends being equivalent to about ½ of wavelength used. The radio terminal has a plurality of antennas associated with the present invention arranged on a plurality of surfaces and provides a connection mechanism for varying the number of antennas to be used in the talk mode and the standby mode.

20 Claims, 17 Drawing Sheets

COAXIAL RESONANT SLOT ANTENNA, A METHOD OF MANUFACTURING THEREOF, AND A RADIO TERMINAL

BACKGROUND OF THE INVENTION (1) Field of the Invention

The present invention relates to an antenna suitable for use in a radio terminal and, more particularly, to a slot antenna using a coaxial cavity, a method of manufacturing such a slot antenna, and a radio terminal incorporating such a slot antenna.

(2) Description of the Prior Art

In radio terminals such as a personal handy phone system (PHS), the antenna of built-in type is increasingly used to enhance portability. Conventional antennas that can be built in radio terminals include the inverted F antenna such as disclosed in Japanese Patent Laid-open (Kokai) No. Hei 6-177629 and the microstrip antenna such as disclosed in Japanese Patent Laid-open (Kokai) No. Hei 5-327331. However, to allocate an enough band, it is required to make the dimensions of an antenna large, thereby making it difficult to build the antenna in a small-sized radio terminal. Besides, even if the antenna can be built in the radio terminal, an induced current is generated on the casing of the radio terminal by the radiation of electromagnetic wave emitted from the antenna, part of the generated induced current flowing in the operator's hand.

To solve such problems, a slot antenna using a coaxial cavity that operates in the TEM (Transverse Electromagnetic) mode was proposed (refer to Japanese Patent Laid-open (Kokai) No. Hei 5-14047 for example). Such a prior-art coaxial resonant slot antenna is shown in FIGS. 27A and 27B. FIG. 27A is a perspective view of the conventional antenna while FIG. 27B is a cross section along line 27B—27B of FIG. 27A. In the prior-art coaxial resonant slot antenna, a long strip conductor 53 is arranged along the resonant axis in the inner space of a conductive cubic 51 which is a rectangular prism in its entirety. Both ends 57 of the strip conductor are fixed on side walls 54 of the conductive cubic 51 in an electrically contact manner (refer to the cross section of FIG. 27B). The conductive cubic 51 is formed on one surface (an electromagnetic wave radiation surface) thereof with a slot 52 which crosses one end of the strip conductor 53. Further, an additional conductor 55 of center conductor of coaxial line is arranged along the length (the resonant axis) of the strip conductor 53 on an inner wall of the conductive cubic 51 at the other end of the strip conductor 53. It should be note that the conductive cubic 51 is maintained at ground potential by an outer conductor 56.

The conductive cubic 51 and the strip conductor 53 form, in cooperation, a coaxial resonant circuit in the TEM mode. Therefore, an electromagnetic wave (a transmission signal) supplied into the conductive cubic 51 via the additional conductor 55 progresses along the strip conductor 53 to be radiated into outside space via the slot 52. On the other hand, an electromagnetic wave (a receiving signal) entered in the conductive cubic 51 via the slot 55 from outside space progresses in the opposite direction along the strip conductor 53 to be picked up by the additional conductor 55.

Because the conventional coaxial resonant slot antenna has the strip conductor 53 with both ends 57 thereof electrically connected to the conductor cubic 51, it is necessary to set the total length of the antenna to ½ of a wavelength in use. Only when this setting is made, a value obtained by doubling the length of the conductive cubic 51 (or the length of the strip conductor 53) provides a resonant wavelength in the TEM mode, so that the intensity of electric field (amplitude) of the electromagnetic wave progressing through the conductive cubic becomes zero at the both ends 57 of the strip conductor 53 and reaches a maximum level at the center of the strip conductor 53. This denotes that it is impossible in principle to build the conventional coaxial resonant slot antenna in a radio terminal of which length along resonant axis is equivalent to less than ½ of wavelength in use. For example, at a frequency of 1.9 GHz used in the PHS, the ½ wavelength is about 80 mm, thus making it impossible to reduce the dimensions of radio terminals using such a frequency to less than 80 mm. In other words, if the conventional coaxial resonant slot antenna shown in FIG. 27 is built in a radio terminal, the dimensions of such a radio terminal cannot be reduced to less than ½ of the wavelength used.

SUMMARY OF THE INVENTION

It is therefore an object of the present invention to provide a coaxial resonant slot antenna having a novel constitution which solves the above-mentioned problems and contributes to further reduction in the dimensions of the radio terminal incorporated with this antenna. Another object of the present invention is to provide a novel method of manufacturing the coaxial resonant slot antenna according to the present invention and a radio terminal having a novel constitution incorporated with the coaxial resonant slot antenna according to the present invention.

The above-mentioned problems can be effectively solved by arranging an entire strip conductor in the inner space of a conductive cubic in a manner in which the strip conductor is electrically insulated from the conductive cubic and an electric connection point between the strip conductor and a radio frequency signal transmission line is provided at a position equivalent to about ¼ wavelength of a wavelength used from one end of the strip conductor. It is necessary to provide insulation between the strip conductor and the conductive cubic by appropriate means. Generally, it is desirable to support the strip conductor by filling the inner space of the flat conductive cubic with an insulation material. For the insulator to be filled inside the inner space of the conductive cubic, a polymer having an appropriate permittivity (for example, a permittivity generally the same as that of outside space) may be used. In order to obtain good resonance characteristics and reduce the dimensions of the antenna, a dielectric material (for example, ceramics) having a high permittivity and good high frequency characteristics is used. Alternatively, it is desired to use a polymer containing a magnetic material in an appropriate ratio or a magnetic material (for example, a magnetic oxide insulator) having good insulation (a low conductivity). Then, the dimensions of the antenna may be reduced approximately to values obtained by dividing the wavelength by square root of permittivity or magnetic permeability.

The coaxial resonant slot antenna according to the present invention can be easily manufactured by arranging a strip conductor inside inner space of a conductive cubic constituted forming a metal plate into a hollow rectangular prism. In mass production, however, as will be described later specifically, it is desired to manufacture the coaxial resonant slot antenna according to the present invention such that two layers of planar insulators are used, the first metallic film is formed on the front surface of the upper planar insulation, the second metallic film is formed on the rear surface of the lower metallic film, a slot is formed on at least one of the first and second metallic films, the third metallic film is formed between the upper and lower planar insulators, and a plurality of metallized through-holes are formed through the peripheries of the upper and lower planar insulators. In this case, the conductive cubic is constituted by the first and second metallic films and the plurality of metallized through-holes and the strip conductor is formed by the third metallic film.

In the above-mentioned coaxial resonant slot antenna according to the invention, a coaxial line with the conductive cubic being an outer conductor and the strip conductor being an inner conductor is formed. When a signal is supplied from the connection point to the strip conductor, the electromagnetic wave propagates along the length of the strip conductor in the TEM mode. In this way, the resonance of ¼ wavelength can be generated when the signal is the wavelength in use such that the intensity of electric field reaches the maximum level at one end of the strip conductor and the minimum level at the connection point. By the electromagnetic wave that formed the resonance, the electromagnetic wave is radiated from the slot to the outside space.

When the antenna according to the invention is used for a receiving antenna, the electromagnetic wave that was absorbed from the slot and has progressed through the conductive cubic to the connection point while forming the resonance is picked up by the connection point.

It should be noted that the cubic space containing the strip conductor that extends from the connection point on the strip conductor to the end opposite to the above-mentioned end may be used as a stub (a matching circuit) of a type as required. By varying the length from the opposite end to the connection point, the impedance matching of the coaxial cavity can be adjusted to realize a good impedance matching condition. The adjustment is made by a degree in which the impedance is corrected slightly, so that its length is generally very short as compared with ¼ of the wavelength in use. Consequently, the depth of the conductive cubic can be set only slightly beyond the ¼ wavelength, thereby reducing the dimensions of the antenna to about a half of those of the conventional antenna which are equivalent to the ½ wavelength.

Further, when the slot is arranged such that it crosses the progressive direction of electromagnetic wave, the electromagnetic wave of the TEM mode that propagates inside the conductive cubic is intensely radiated from the slot and the electromagnetic wave in the outside space is absorbed in the slot. Especially, when the total length of the slot is near ½ of the wavelength in use, the electromagnetic waves in the inner and outer spaces connect with the slot strongly. If the slot is bent halfway, its total length (the length of the slot straightened) determines the efficiency. Therefore, by bending the slot, the width of the cubic (the dimension relative to the length of the front surface of the cubic) can be reduced, which will be described later. Actually, the width of the cubic can be selected from ¼ to ⅛ of the wavelength in use. Thus, the width of the conductive cubic may also be reduced by a half to ¼ as required, which is equivalent to ½ of the wavelength conventionally.

Moreover, the above-mentioned novel manufacturing method may be applied such that the coaxial resonant slot antenna according to the present invention is embedded in a multilayer circuit board mounted with radio frequency components in a radio terminal, thereby reducing the cost and size of the radio terminal.

The foregoing and other objects, advantages, manner of operation and novel features of the present invention will be understood from the following detailed description when read in connection with the accompanying drawings.

DESCRIPTION OF THE PREFERRED EMBODIMENTS

The following describes, in further detail, a coaxial resonant slot antenna and a method of fabricating the same according to the present invention and a radio terminal incorporating the coaxial resonant slot antenna according to the present invention, by way of preferred embodiments of the present invention with reference to the accompanying drawings.

Figure 1A:
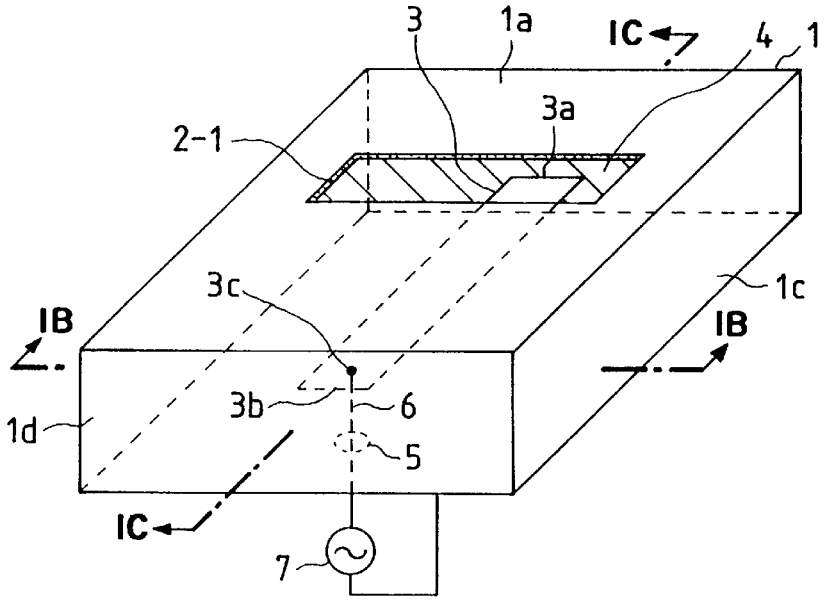
FIG. 1A is a perspective view illustrating the coaxial resonant slot antenna practiced as a first preferred embodiment of the present invention.
Figure 1B:
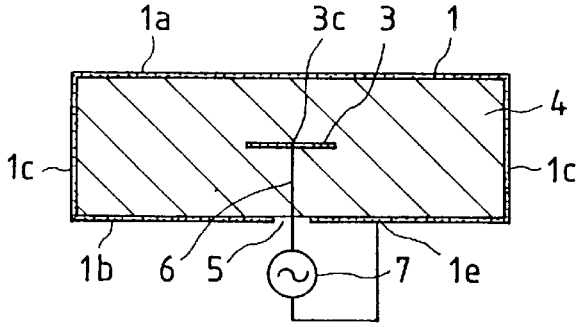
FIG. 1B is a cross section illustrating the coaxial resonant slot antenna practiced as the first preferred embodiment of the present invention.

Now, referring to FIG. 1A, a perspective diagram is shown which illustrates the coaxial resonant slot antenna practiced as the first preferred embodiment of the present invention. FIG. 1B is a cross section along line 1B—1B of FIG. 1A, while FIG. 1C is another cross section along line 1C—1C of FIG. 1A.

In these figures, reference numeral 1 indicates a conductor cubic of rectangular prism; reference numeral 1*d* indicates a side wall of the conductor cubic 1; reference numeral 1*e* indicates a ground point to a rear surface 1*b* of the conductor cubic 1 of a radio frequency transmission line; reference numeral 2-1 indicates a slot provided in a front surface 1*a* of the conductive cubic 1; reference numeral 3 indicates a strip conductor arranged inside the conductor cubic 1 in parallel to the front surface 1*a* and the rear surface 1*b;* reference numerals 3*a* and 3*b* indicate ends of the strip conductor 3; reference numeral 3*c* indicates a connection point to the radio frequency transmission line on the strip conductor 3; reference numeral 4 indicates a support for the strip conductor 3 consisting of an insulator filled up inside the conductive cubic 1; reference numeral 5 indicates a hole provided in the rear surface 1*b* of the conductive cubic 1; reference numeral 6 indicates a linear conductor connected to the connection point 3*c* through the hole 5 from outside the conductor cubic 1; and reference numeral 7 indicates a radio frequency circuit for generating a transmission signal and processes a receiving signal.

Figure 1C:
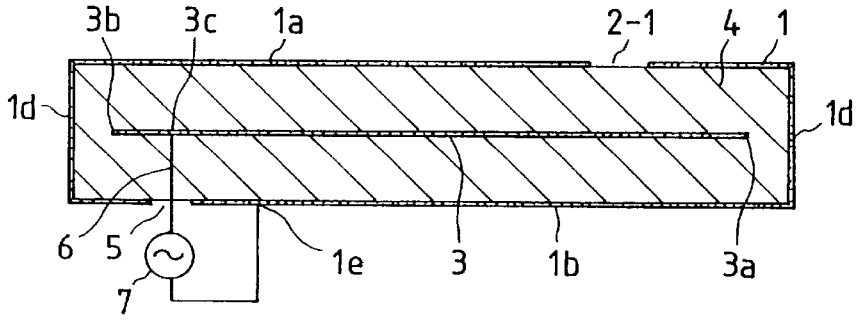
FIG. 1C is another cross section illustrating the coaxial resonant slot antenna practiced as the first preferred embodiment of the present invention.

Positional relationships of the conductor cubic 1, the slot 2-1, and the strip conductor 3 are shown in the cross section of FIG. 1B taken along line 1B—1B of FIG. 1A and the cross section of FIG. 1C taken along line 1C—1C of FIG. 1A. As shown, the conductor cubic 1 is filled up with the insulator having generally the same permittivity as that of free space and good insulation and high-frequency characteristics. This insulator is used as the support 4, in which the strip conductor 3 is supported such that both ends 3*a* and 3*b* of the strip conductor 3 are slightly separated away from the side wall 1*d* and the strip conductor 3 is not in electrical contact with any sides of the conductive cubic 1. Further, the distance between one side 3*a* of the strip conductor 3 and the connection point 3*c* is set to a value equivalent to ¼ of a wavelength used. The slot 2-1 is arranged near the end 3*a* such that the slot crosses the strip conductor 3. Use of this constitution can form a coaxial cavity of TEM mode with the strip conductor 3 serving as the center conductor and the conductive cubic 1 serving as the outer conductor. The resonant frequency is set to 1. 9 GHz and the length (depth) of the conductive cubic 1 is set to a value slightly beyond ¼ of the wavelength used (namely, about 40 mm).

Power supply and reception of the coaxial resonant slot antenna of the present embodiment are performed between the connection point 3*c* on the strip conductor 3 connected with the linear conductor 6 via the radio frequency transmission line and the ground point 1*e* on the rear side of the conductor cubic 1. The output impedance of the transmission circuit and the input impedance of the receiving circuit of the radio frequency circuit 7 connected to the radio frequency transmission line are both set to low values (50 ohms). The ground potential of the radio frequency circuit 7 is equal to the conductor cubic 1 and a transmission signal coming from the radio frequency circuit 7 is supplied to the strip conductor 3 through the linear conductor 6 and a receiving signal coming from the strip conductor 3 is transmitted to the radio frequency circuit 7. The supplied transmission signal becomes an electromagnetic wave having a high-frequency energy and progresses toward the slot along the length of the strip conductor 3 in the TEM mode. An electromagnetic wave absorbed from the slot progresses toward the connection point along the length of the strip conductor 3 in the TEM mode.

Since the electromagnetic wave is of TEM mode, there is no lower limit in cutoff frequency on the plane orthogonal to the strip conductor 3 along its length. Consequently, even if the height (the dimension vertical to the front surface of the conductive cubic 1) of the conductive cubic 1 is reduced, the transmission of the high-frequency energy is not inversely affected as long as no break down is caused between the strip conductor 3 and the conductive cubic 1. The limitation to the height of the conductive cubic 1 is determined by break down and mechanical durability. Practically, the height can be set to a value equivalent to about 1/100 of the wavelength. In the coaxial resonant slot antenna of the present embodiment, the height of the conductive cubic 1 was set to a value equivalent to about 1/75 of the wavelength (namely, about 2 mm).

When the high-frequency energy progresses as the electromagnetic wave of the TEM mode to induce a current on the strip conductor 3, a current in the opposite direction flows on the surface of the conductive cubic 1. The current in the opposite direction concentrates on a portion nearest the strip conductor 3. Therefore, if the strip conductor 3 crosses the slot 2-1 immediately below the same, the high-frequency energy supplied from the connection point of the strip conductor 3 concentrates on the slot 2-1 to be connected with the same, being radiated into the outer space. Hence, the slot 2-1 was arranged such that the same crosses the strip conductor 3 immediately above the same along the length of the same (namely, along the line 1C—1C of FIG. 1A) and near the end 3*a* at which the amplitude of electromagnetic field becomes large inside the conductive cubic 1. It should be noted that the current induced on the strip conductor 3 is zero because the strip conductor 3 is open at the end 3*a*. Consequently, if a portion from the end 3*a* to the wall 1*d* is included immediately below the slot 2-1, the slot 2-1 is not fully oscillated, thereby preventing the high-frequency energy being efficiently radiated into the outer space. Therefore, the slot 2-1 was arranged such that the strip conductor 3 crosses with slot 2-1 immediately below the same without gap.

The surface of the conductive cubic is equal to the ground potential. Each side of the conductive cubic 1 operates as a reflective plate for the energy concentrated on the slot 2-1. Therefore, the slot 2-1 can radiate the electromagnetic wave concentratedly on one side vertical to the surface. Consequently, if the coaxial resonant slot antenna according of the present embodiment is built in the radio terminal, the direction in which the electromagnetic wave is radiated can be arranged opposite to the operator in talking, concentratedly radiating the electromagnetic wave in the direction opposite to the body of the operator. This arrangement prevents the electromagnetic wave from being absorbed in the body of the operator, thereby enhancing the sensitivity of the radio terminal in the talk mode.

In the coaxial resonant slot antenna of the present embodiment, the strip conductor 3 is supported by the support 4 filled up in the conductor cubic 1. It will be apparent to those skilled in the art that the strip conductor 3 can also be supported partially by a plurality of small blocks depending on the rigidity of the strip conductor 3.

It is also possible to arrange the slot on the rear side of the conductive cubic 1. Further, two slot may be used to radiate the electromagnetic wave from both sides.

In what follows, the coaxial resonant slot antenna with the slot shape modified, practiced as the second preferred embodiment will be described with reference to FIGS. 2 through 6.

Figure 2:
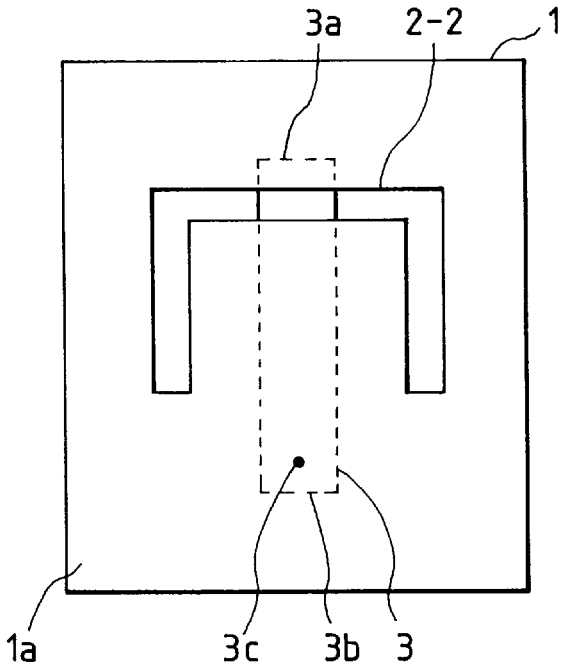
FIG. 2 is a top view illustrating the coaxial resonant slot antenna practiced as a second preferred embodiment of the present invention.

FIG. 2 shows an example in which slot 2—2 has a generally upside-down "U" shape. As shown in FIG. 2, of three slot elements that constitute the slot having the generally upside-down "U" shape, the center slot element having no end is made cross the strip conductor 3 along the length of the same. A high-frequency energy propagated from the connection point 3*c* along the strip conductor 3 is connected with the slot 2—2 to be radiated into the outer space. To increase the radiation efficiency, the total length of the slot 2—2 was set to a value equivalent to ½ of the wavelength used. By bending the slot, the width of the conductive cubic 1 may be reduced to a value equivalent to ¼ to ⅛ of the wavelength (in the present embodiment, 40 mm to 20 mm), thereby reducing the dimensions of the coaxial resonant slot antenna. It may be yielded that the slot 2—2 has a normal "U" shape while the slot 2—2 has the generally upside-down "U" shape shown in FIG. 2.

Figure 3:
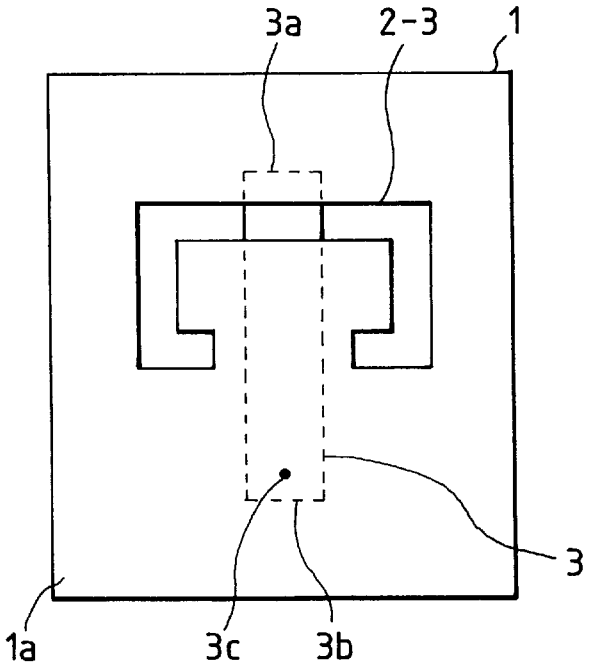
FIG. 3 is another top view illustrating the coaxial resonant slot antenna practiced as the second preferred embodiment of the present invention.

FIG. 3 shows an embodiment having a slot 2-3 in which each end of the generally upside-down "U" shaped slot 2—2 is bent inside in the direction perpendicular to the length of the strip conductor 3. The effective length of the slot 2-3 can be further reduced, in turn further reducing the width of the conductive cubic. Thus, this embodiment eventually contributes to the reduction of the dimensions of the coaxial resonant slot antenna.

Figure 4:
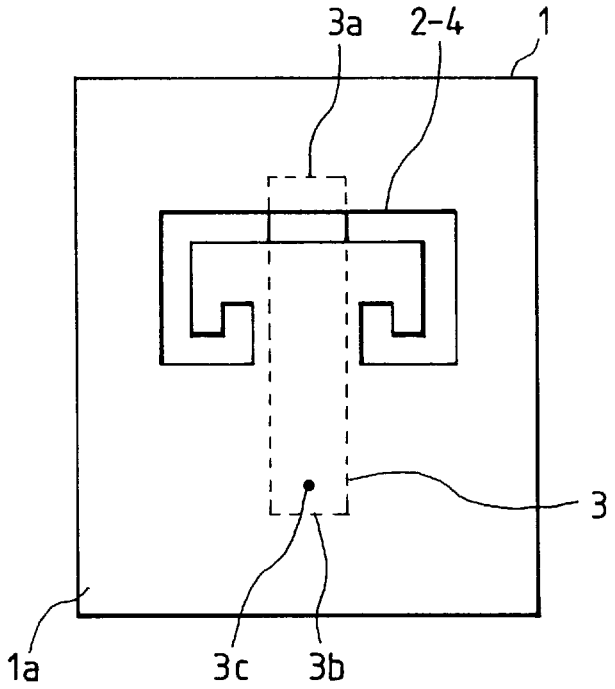
FIG. 4 is still another top view illustrating the coaxial resonant slot antenna practiced as the second preferred embodiment of the present invention.

FIG. 4 show an embodiment having a slot 2-4 in which each end of the slot 2-3 is further bent inside along the length of the strip conductor. According to the embodiment of FIG. 4, the width of the conductive cubic 1 can be further reduced, in turn further reducing the dimensions of the coaxial resonant slot antenna.

Figure 5:
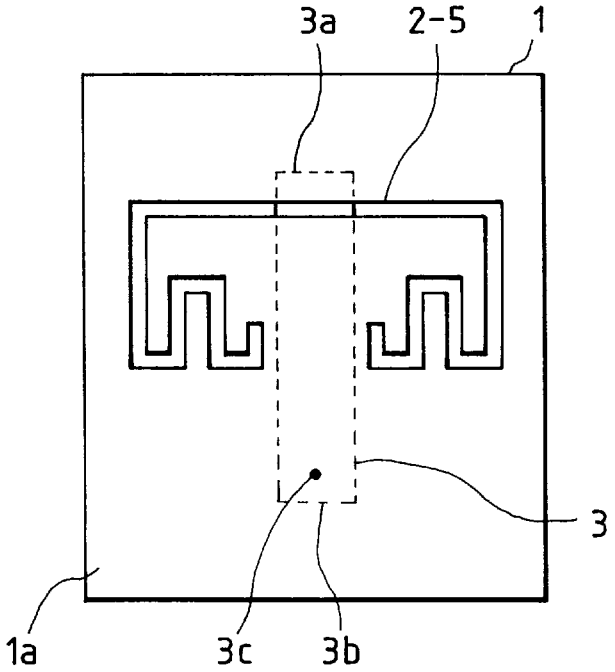
FIG. 5 is yet another top view illustrating the coaxial resonant slot antenna practiced as the second preferred embodiment of the present invention.
Figure 6:
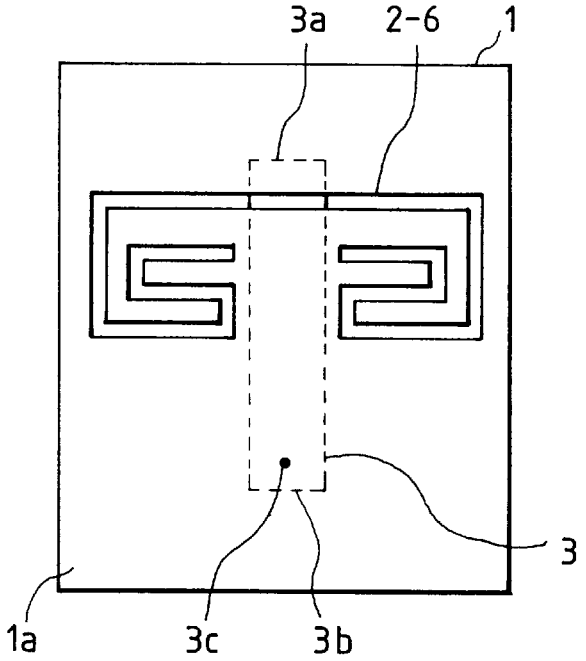
FIG. 6 is a separate top view illustrating the coaxial resonant slot antenna practiced as the second preferred embodiment of the present invention.

FIG. 5 and FIG. 6 show embodiment having a slot 2-5 and a slot 2-6 respectively. Each of the slots 2-5 and 2-6 has meander ends. In the slot of FIG. 5, each end extends in the direction of the strip conductor 3. In the slot of FIG. 6, each end extends toward a point connecting to the strip conductor 3. According to the embodiments of FIGS. 5 and 6, the width of the conductive cubic 1 can be reduced still further, resulting in still further reduction in the dimensions of the coaxial resonant slot antenna.

In each slot of the embodiments of FIGS. 2 through 6, the center slot element serves as the basic slot. In the embodiment of FIG. 2, each end of the basic slot is added with a slot element of which length is perpendicular to the length of the basic slot. In the embodiments of FIGS. 3 through 6, each end of the basic slot is added alternately with a slot element of which length is perpendicular to the length of the basic slot, another slot element of which length is horizontal to the length of the basic slot, still another slot element of which length is perpendicular to the length of the basic slot, and so on. In such a structure, the additional slots other than the basic slot are made pass the center point of the center axis along the length of the basic slot and made symmetrical around the axis at right angles to the length of the basic slot. Further, the both ends of the slots are made opposite to each other. Moreover, the basic slot is made cross the strip conductor 3. In this case, the slots other than the basic slot are made not to overlap on the strip conductor 3.

Figure 7A:
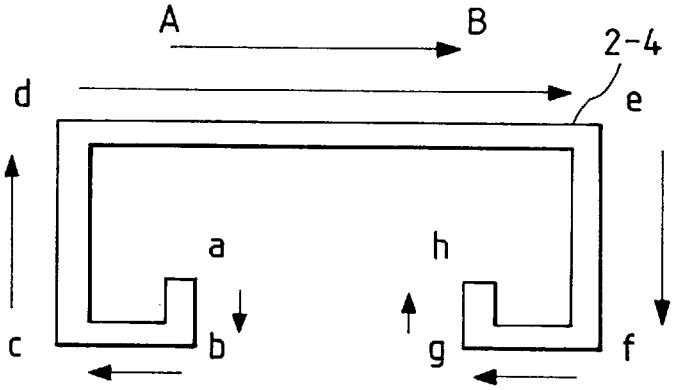
FIG. 7A is a top view illustrating a slot structure of the coaxial resonant slot antenna of FIG. 3.
Figure 7B:
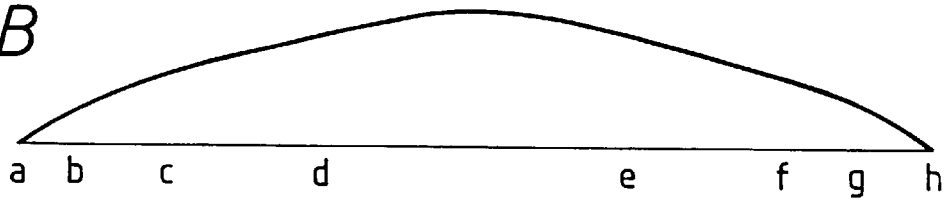
FIG. 7B is a graph describing an electric field pattern of the coaxial resonant slot antenna of FIG. 3.

The following describes the relationship between the pattern of an electroic field induced on the slot of the coaxial resonant slot antenna according to the present invention and the radiated electromagnetic energy by using the slot 2-4 of FIG. 4 for example. FIGS. 7A and 7B show the pattern of an electric field induced on the slot of 2-4. As shown in FIG. 7B, a sine-shaped electric field is induced along the slot 2-4. As shown in FIG. 7A, electromagnetic energies radiated from electric fields induced at portions a–b, g–h, c–d and e–f of the slot 2-4 cancel each other, not contributing to radiation. The direction of the electric fields induced at portions b–c and f–g of the slot 2-4 and the direction of the electric field induced at portion d-e of the slot 2-4 cancel each other. However, as shown in FIG. 7B, the amplitudes of the induced electric fields differ greatly from each other, so that the electromagnetic energy coming from the portion d–e of the slot 2-4 is radiated around portion A–B of the slot 2-4.

Consequently, it can be said that a portion in each of the slots of FIGS. 2 through 6 which mainly radiates the electromagnetic energy lies immediately above the strip conductor 3 in which there is no electric field cancellation. Of the bent slots, it is desired to shorten the portion perpendicular to the strip conductor 3 and which causes the cancellation on the portion for radiating electromagnetic energy.

Figure 8:
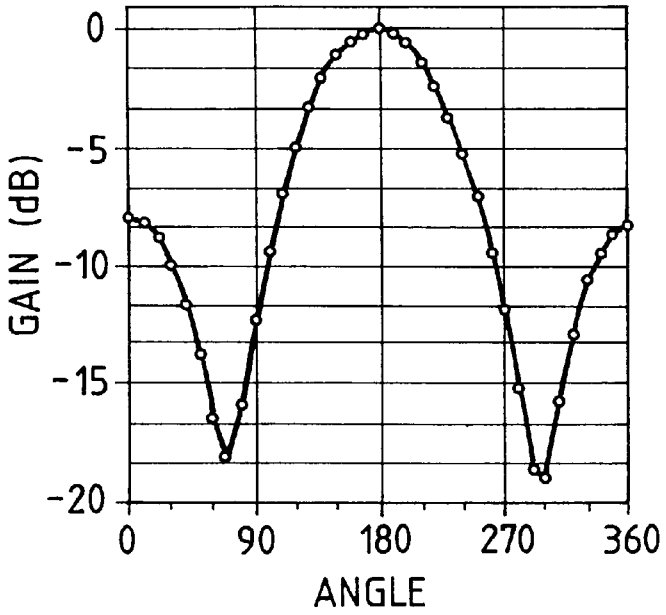
FIG. 8 is a graph describing radiation characteristics (pattern) of the coaxial resonant slot antenna of FIG. 5.

For an example of the radiation characteristics (pattern) of the coaxial resonant slot antenna according to the present invention, FIG. 8 shows a radiation pattern (namely, the radiation pattern in the plane orthogonal to the strip conductor 3 in the length of the same) of the slot-like antenna of FIG. 3. This antenna has a length being equivalent to about ¼ of wavelength, a width being equivalent to about ¼ of wavelength, and a height being equivalent to about 1/75 of wavelength. The outside direction normal to the plane on which the slot exists matches 180 degrees of FIG. 8. As apparent from FIG. 8, a difference in the radiation energy of the electromagnetic wave to the planes opposite (0 and 360 degrees) to the plane on which the slot is arranged is 8 dB, thereby suppressing the radiation to the planes on which the slot is not arranged. Therefore, use of this antenna for a built-in antenna of a radio terminal makes the same provide single-side radiation pattern.

Figure 9:
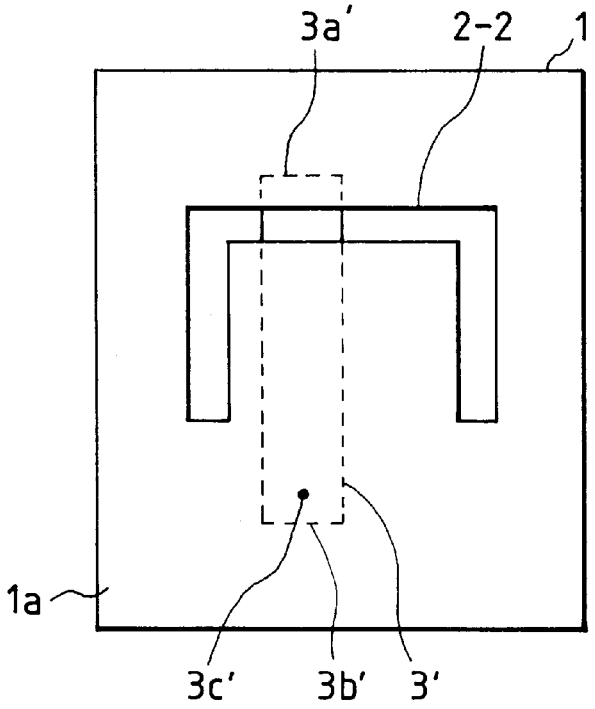
FIG. 9 is a top view illustrating the coaxial resonant slot antenna practiced as a third preferred embodiment of the present invention.

The following describes the coaxial resonant slot antenna practiced as the third preferred embodiment of the present invention with reference to FIG. 9, in which the strip conductor is arranged at a position away from the center of the conductive cubic 1.

FIG. 9 shows the third embodiment in which a strip conductor 3' is arranged at a position off the center of the conductive cubic 1 in parallel to the surface 1*a* of the conductive cubic 1 in the coaxial resonant slot antenna having the slot shape of FIG. 2. It should be noted that the strip conductor 3' is arranged in a range does not overlap the left and right slot elements. In the coaxial resonant slot antenna of this embodiment, the slot 2-2 is formed above the strip conductor 3' in the conductive cubic 1 crossing the length of the strip conductor 3', so that high-frequency energy is efficiently radiated from the slot 2-2. A connection point 3*c*' is also shifted along with the strip conductor 3', so that the strip conductor 3' can be set by determining the position of the connection point 3*c*' first. As a result, the position of the connection point 3*c*' can be selected with some degree of freedom, so that the position of the radio frequency circuit 7 can be selected with some degree of freedom in mounting the coaxial resonant slot antenna according to the present invention into the casing of a radio terminal.

Figure 10A:
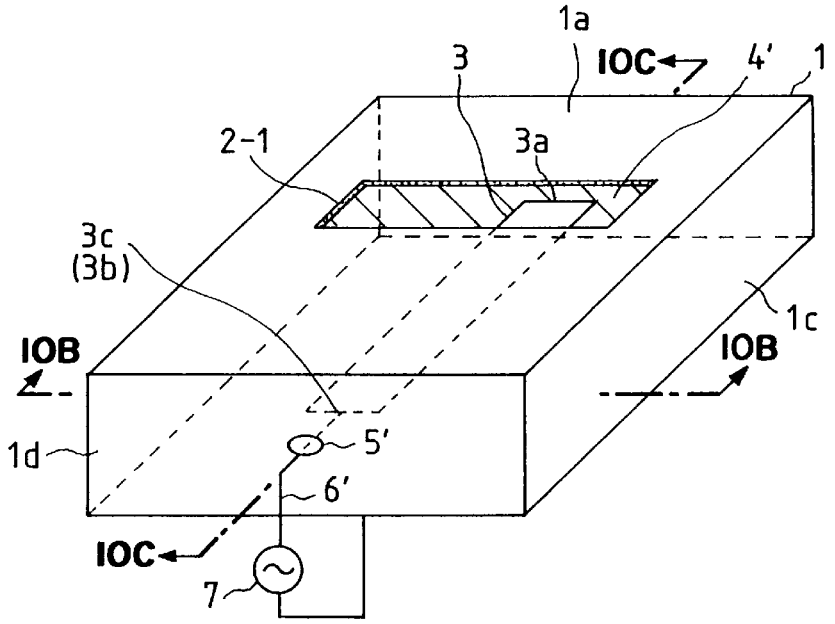
FIG. 10A is a perspective view illustrating the coaxial resonant slot antenna practiced as a fourth preferred embodiment of the present invention.
Figure 10B:
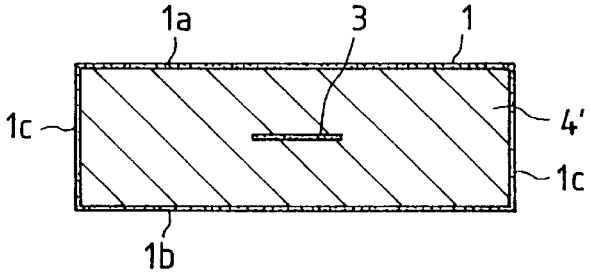
FIG. 10B is a cross section illustrating the coaxial resonant slot antenna practiced as the fourth preferred embodiment of the present invention.
Figure 10C:
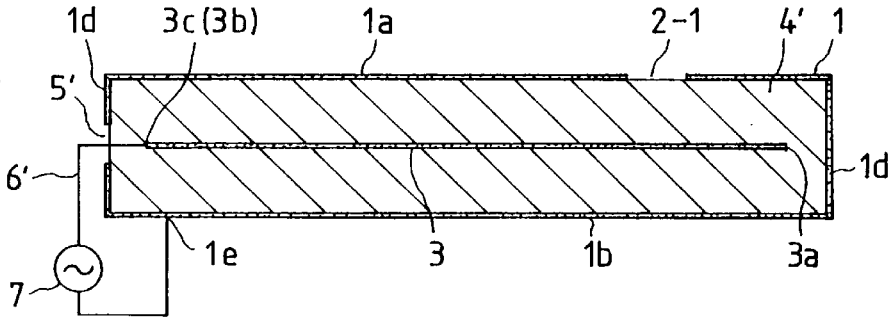
FIG. 10C is another cross section illustrating the coaxial resonant slot antenna practiced as the fourth preferred embodiment of the present invention.

The following describes the coaxial resonant slot antenna practiced as the fourth preferred embodiment of the present invention with reference to FIGS. 10A, 10B and 10C, in which a radio frequency transmission line is arranged through the side wall 1*d* of the end 3*b* of the strip conductor 3. FIG. 10A is a perspective view illustrating the fourth embodiment. FIG. 10B is a cross section along line 10B—10B of FIG. 10A. FIG. 10C is a cross section along line 10C—10C of FIG. 10A. In these figures, reference numeral 5' indicates a small hole provided in the side wall 1*d* of the conductive cubic 1 and reference numeral 6' indicates a linear conductor connected to the connection point 3*c* of the strip conductor 3 through the small hole 5'. The connection point 3*c* of the strip conductor 3 matches the end 3*b* of the strip conductor 3. The ground point 1*e* is one point on the rear surface of the conductive cubic 1. It should be noted that the ground point 1*e* may be provided on the side wall 1*d* near the small hole 5' instead of the rear surface. In the coaxial resonant slot antenna of this embodiment, the total length of the strip conductor 3 is set to a value equivalent to ¼ of the wavelength used.

The above-mentioned fourth embodiment practices the coaxial resonant slot antenna with a dielectric material 4' higher in permittivity and lower in high-frequency loss than that used in the first embodiment filled in the conductive cubic 1. Like the first embodiment, the dielectric material 4' provides the support for the strip conductor 3. The electromagnetic field inside the conductive cubic 1 is reduced by the square root of the permittivity of the dielectric material 4', so that the resonance frequency drops to a value obtained by dividing the resonance frequency by the square root of the permittivity with the dimensions kept without change. Consequently, for the same resonance frequency, the dimensions of the conductive cubic 1 can be reduced to the value obtained by dividing the dimensions by the square root of the permittivity.

It should be noted that discontinuity in the permittivity occurs between the outer space and the space inside the conductive cubic 1 with the plane of the slot 2-1 being the boundary of the discontinuity, so that the reflection of the high-frequency energy radiated from the slot 2-1 increases in the frequency band outside the resonance frequency. Consequently, the coaxial resonant slot antenna of this embodiment has a characteristic that makes the frequency bandwidth narrow. It is therefore desired that this coaxial resonant slot antenna be used in applications permitting such a limitation.

It should also be noted that, instead of the dielectric material 4', a magnetic material having a conductivity as low as mitigating the reduction of Q-value of resonation inside the conductive cubic 1 may be used. In this case, too, the dimensions of the conductive cubic 1 may be set to a value obtained by dividing the dimensions without the filler by the square root of the permittivity.

Figure 11A:
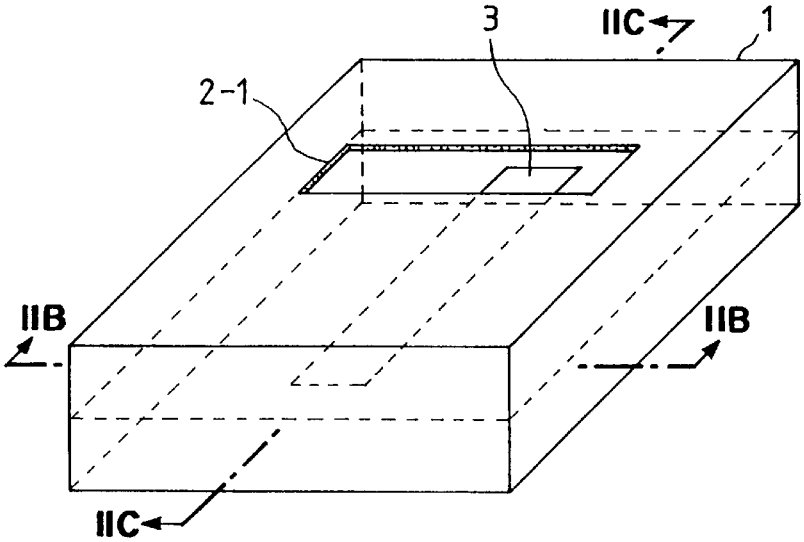
FIG. 11A is a perspective view illustrating the coaxial resonant slot antenna practiced as a fifth preferred embodiment of the present invention.
Figure 11B:
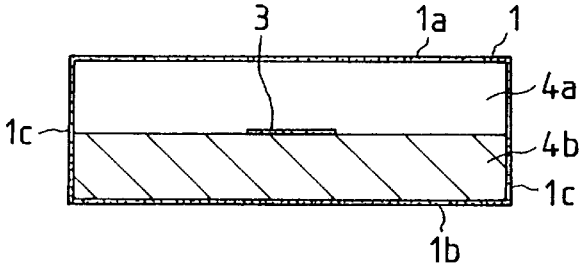
FIG. 11B is a cross section illustrating the coaxial resonant slot antenna practiced as the fifth preferred embodiment of the present invention.
Figure 11C:
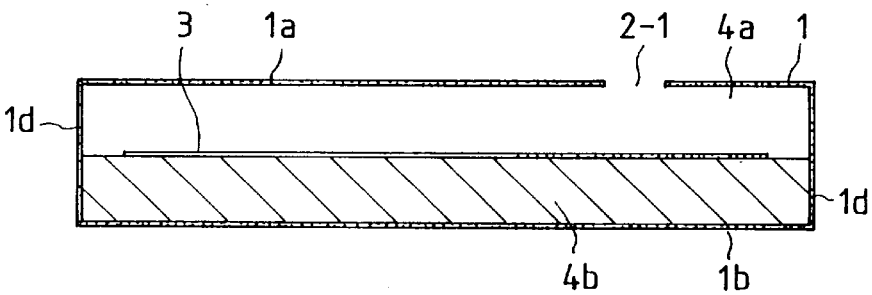
FIG. 11C is another cross section illustrating the coaxial resonant slot antenna practiced as a fifth preferred embodiment of the present invention.

The following describes the coaxial resonant slot antenna practiced as the fifth preferred embodiment of the present invention with reference to FIGS. 11A, 11B and 11C, in which the dielectric material is filled only in a space between the bottom surface in the conductive cubic 1 and the plane of the strip conductor 3. FIG. 11A shows a perspective view of the fifth embodiment. FIG. 11B is a cross section along line 11B—11B of FIG. 11A. FIG. 11C is a cross section along line 11C—11C of FIG. 11A. It should be noted that the small holes 5 and 5', the linear conductors 6, and 6', and the radio frequency circuit 7 are not shown in these figures. In these figures, reference numeral 4*b* indicates a filled dielectric material. The strip conductor 3 is arranged on top of the dielectric material 4*b*. The fifth embodiment reduces the dimension reduction effect of the coaxial resonant slot antenna as compared with the fourth embodiment. But, because the discontinuity in permittivity is not caused between the outer space and the space 4*a* in the conductive cubic 1, the high-frequency energy radiated from the slot 2-1 is not reflected, thereby suppressing the reduction in frequency bandwidth.

It should be noted that, in the fifth embodiment, too, instead of the dielectric material 4*b*, a magnetic material having a conductivity as low as mitigating the reduction of Q-value of resonation inside the conductive cubic 1 may be used. In this case, generally the same effect can be achieved as with the dielectric material 4*b*.

It should also be noted that the space 4*b* between the strip conductor 3 and the upper surface inside the conductive cubic 1 may be filled with a material having a lower permittivity than that of the dielectric material 4*b*. In this case, a coaxial resonant slot antenna having an intermediate characteristic between the fifth and fourth embodiments.

Figure 12A:
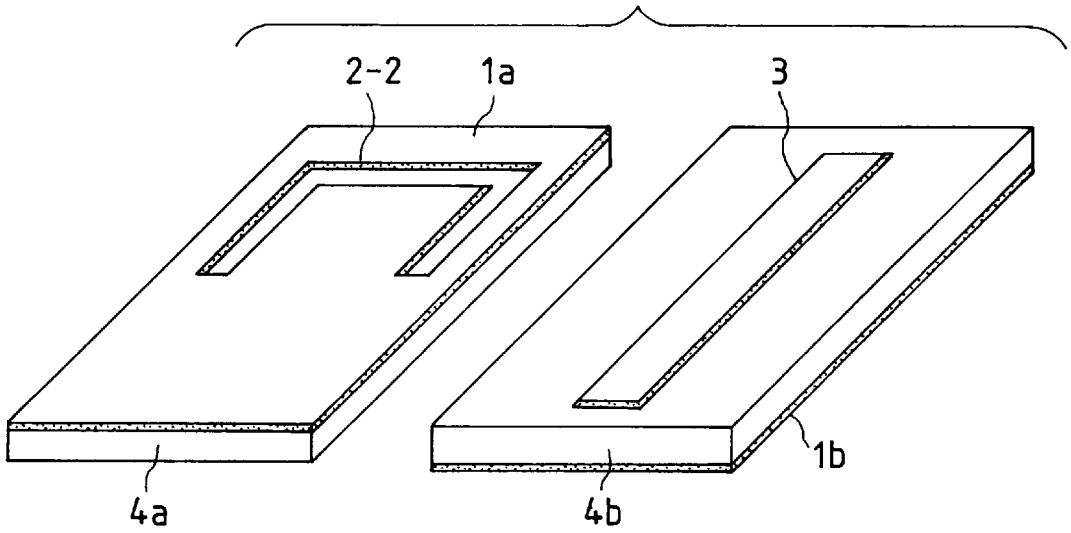
FIG. 12A is a perspective view illustrating a method of fabricating the coaxial resonant slot antenna practiced as a first preferred embodiment of the present invention.
Figure 12B:
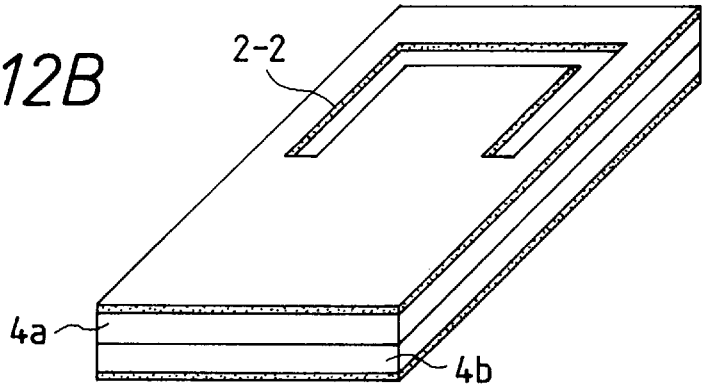
FIG. 12B is another perspective view illustrating the method of fabricating the coaxial resonant slot antenna practiced as the first preferred embodiment of the present invention.
Figure 12C:
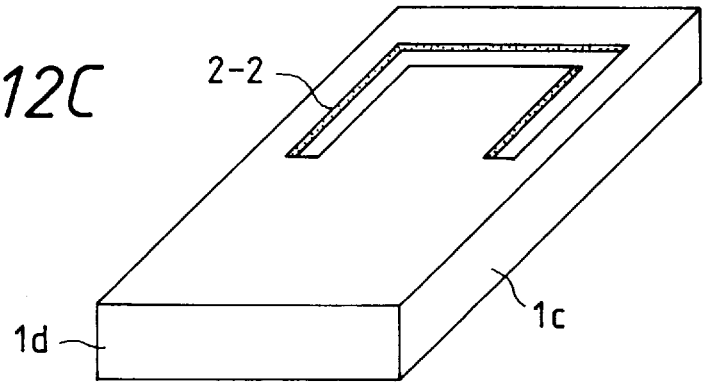
FIG. 12C is still another perspective view illustrating the method of fabricating the coaxial resonant slot antenna practiced as the first preferred embodiment of the present invention.

The following describes the method of fabricating the coaxial resonant slot antenna associated with the present invention with reference to FIGS. 12A, 12B and 12C, the method being practiced as a first embodiment of the invention. In this embodiment, two sheets of planar insulators 4*a* and 4*b* are used. The planar insulator 4*a* is formed only on the surface thereof with a conductor film 1*a*. Therefore, patterning is performed on the front surface by etching to provide the slot 2-2, forming a pattern that provides the front surface of the conductive cubic 1 (the left side of FIG. 12A). The planar insulator 4*b* is formed on both sides with a conductor film 1*b*. Patterning is performed on the front surface by etching to form a pattern that provides the strip conductor 3 (the right side of FIG. 12A) while the small hole 5 is provided on the rear surface by etching to form a pattern that provides the rear surface of the conductive cubic 1. The small hole is formed inside thereof with a metallized through-hole to provide the connection point. The planar insulator 4*a* is bonded to the planar insulator 4*b*, the rear side of the planar insulator 4*a* against the front side of the planar insulator 4*b* (FIG. 12B). Then, the resultant two-layer insulator board is covered around walls thereof with conductor films 1*d* and 1*c*, which are fixed such that the conductor films 1*d* and 1*c* are electrically in contact with a metallic film 1*a* on the front surface of the two-layer insulator board and a metallic film 1*b* on the rear surface, thereby providing the side walls of the conductive cubic 1 (FIG. 12C). According to this method, a printed circuit board can be used for the planar insulators 4*a* and 4*b*, thereby reducing fabrication cost.

Figure 13A:
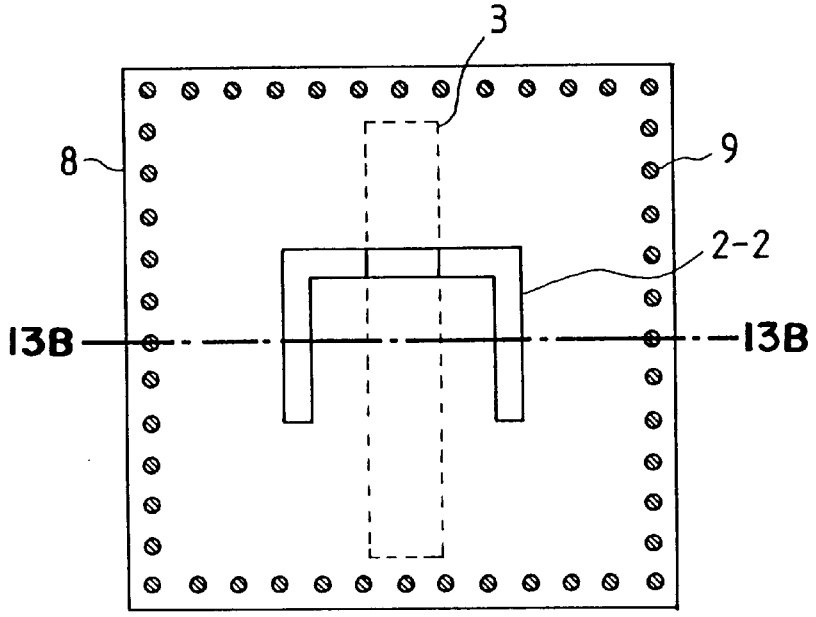
FIG. 13A is a top view illustrating the method of fabricating the coaxial resonant slot antenna practiced as a second preferred embodiment of the present invention.
Figure 13B:
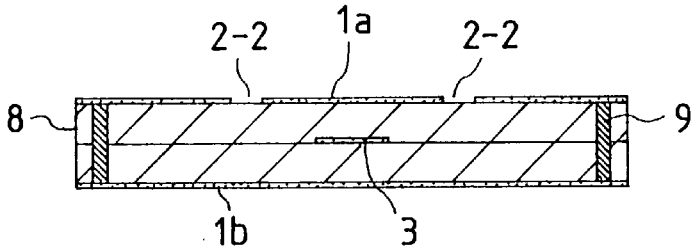
FIG. 13B is a cross section illustrating the method of fabricating the coaxial resonant slot antenna practiced as the second preferred embodiment of the present invention.

The following describes the method of fabricating the coaxial resonant slot antenna associated with the present invention with reference to FIGS. 13A and 13B, the method practiced as a second preferred embodiment of the present invention. In these figures, reference numeral 8 indicates a two-layer insulation board. FIG. 13A shows a top view of the upper planar insulator of the two-layer insulation board 8. FIG. 13B shows a cross section along line 13B—13B of FIG. 13A. The lower planar insulator of the two-layer insulation board is formed on all the rear surface thereof with a conductor film 1*b* that provides a ground board. The strip conductor 3 is formed by patterning between the upper and lower planar insulators. The upper planar insulator is formed by patterning on the front surface thereof with the conductor film 1*a* having the slot 2. Further, a plurality of holes that penetrate both the upper and lower planar insulators in peripheries thereof. The plurality of holes are metallized to provide a plurality of metallized through-holes 9. The plurality of metallized through-holes 9 are for electrically connecting the conductor film 1*a* of the upper planar insulator with the conductor film 1*b* of the lower planar insulator. An interval between adjacent metallized through-holes 9 is set to a value equivalent to less than 1/100 of wavelength so that electromagnetic wave may be suppressed from being exuded from the space enclosed by the plurality of metallized through-holes 9.

The above-mentioned novel constitution allows the conductor film 1*b* on the rear surface of the two-layer insulator board 8 to provide the rear surface of the conductive cubic 1, the conductor film 1*a* on the front surface of the two-layer insulation board 8 to provide the front surface of the conductive cubic 1, and the plurality of metallized through-holes to provide the walls 1*c* and 1*d* of the conductive cubic 1, thereby forming a structure for antenna operation.

Although not shown, the connection point is formed by providing, in the conductor film 1*b* immediately below the connection point of the strip conductor 3, a hole of which diameter is slightly larger than that of the metallized through-hole, the hole being formed inside thereof with a metallized through-hole that reaches only the strip conductor 3.

According to the above-mentioned fabrication method, an ordinary two-dimensional printed circuit board fabrication technique may be applied without requiring three-dimensional fabrication processes, thereby reducing fabrication cost.

It should be noted that the two-layer insulation board 8 can be formed by a flexible material. If the slot antenna thus formed is bent not in the direction along the length of the strip conductor 3 along with electromagnetic wave progresses but gradually in the direction orthogonal to the length of the strip conductor 3, the electromagnetic field inside the slot antenna becomes like a large-diameter coaxial line. Consequently, the TEM mode of the electromagnetic field can be maintained, in turn maintaining antenna operation.

Figure 14A:
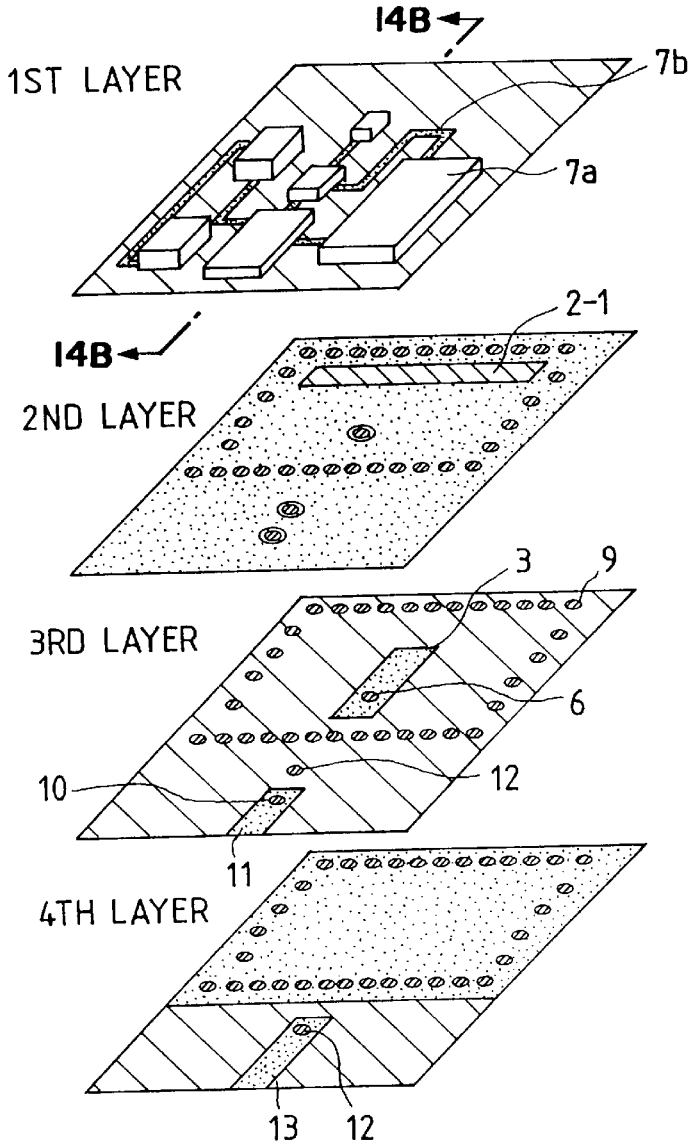
FIG. 14A is a perspective view illustrating a radio terminal incorporating the coaxial resonant slot antenna according to the present invention, the radio terminal being practiced as a first preferred embodiment of the present invention.
Figure 14B:
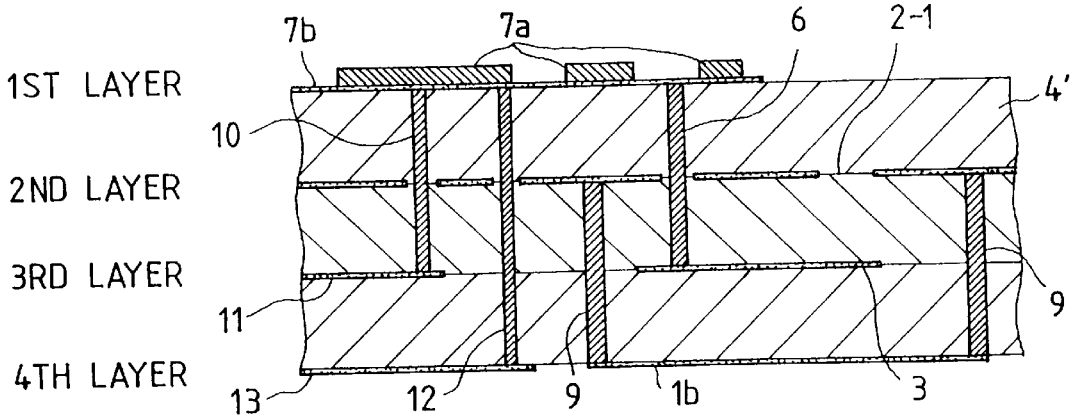
FIG. 14B is a cross section illustrating a radio terminal incorporating the coaxial resonant slot antenna according to the present invention, the radio terminal being practiced as the first preferred embodiment of the present invention.

The following describes the radio terminal incorporating the coaxial resonant slot antenna associated with the present invention with reference to FIGS. 14A and 14B, the radio terminal being practiced as a first preferred embodiment of the present invention. These figures show the embodiment in which the coaxial resonant slot antenna is embedded in a multilayer circuit board mounted with radio frequency components in the casing of the radio terminal. FIG. 14A shows a perspective view illustrating each of stripline layers constituting the multilayer circuit board. FIG. 14B shows a cross section of the multilayer circuit board along line 14B—14B of FIG. 14A. In these figures, the first layer provides a parts mounted surface on which radio frequency components 7*a* and a stripline pattern 7*b* for interconnecting the radio frequency components are mounted. The second layer provides a ground plane on which the conductor is removed to form the slot 2-1 and a plurality of through-holes 9 for cavity wall are formed around the slot 2-1 in a rectangle manner. The third layer is formed with a control line for example. The third layer supplies a control signal to the components mounted on the first layer. The control signal is transmitted along a stripline pattern for control signal 11 which goes through a control-line through-hole 10 by passing the hole in the second layer without electrical contact thereto. The third layer is formed with the strip conductor 3 in an area enclosed by the cavity-wall through-holes 9 without coming in electrical contact with the through-holes 9. A radio frequency power is supplied from the component on the first layer to the strip conductor 3 via an antenna-feed through-hole 6 through the hole in the second layer without electrical contact thereto. The radio frequency power supplied to the strip conductor 3 is radiated from the slot 2-1 formed on the second layer into free space via a dielectric material 4' filled between the first and second layers. The fourth layer is formed with a power-supply stripline for example. The fourth layer supplies a supply power to the components arranged on the first layer. The supply power is transmitted over a power-supply stripline pattern 13 via a power-supply through-hole 12 through the hole on the second layer without electrical contact thereto. The fourth layer is formed with a stripline pattern 1*b* including the through-hole 9 without electrical contact with the power-supply strip line 13, thereby realizing a cubic cavity in the multilayer circuit board by the ground conductor on the second layer and the cavity-wall through-holes 9. Because this constitution operates as the cubic cavity, an interval between adjacent cubic-cavity through-holes 9 is set to a value equivalent to less than 1/200 of the driven frequency of the antenna. According to the above-mentioned embodiment, the coaxial resonant slot antenna can be constituted in the multilayer circuit board, so that three-dimensional mechanical parts for antenna driving such as connectors and coaxial cables can be removed, thereby reducing the cost of the radio terminal associated with the present invention. Further, in the structure constituting the coaxial resonant slot antenna, a portion of the conductor plane on which the slot 2-1 is formed except for the vicinity of the portion around the slot 2-1 can be used as the ground plane, so that the efficiency of mounting the radio frequency components including the antenna increases to reduce the dimensions of the radio terminal as compared with the case in which the portion constituting the antenna is taken out from the multilayer circuit board to connect the portion to the radio frequency circuit board.

The following describes the radio terminal incorporating the coaxial resonant slot antenna associated with the present invention with reference to FIGS. 15A, 15B, FIGS. 16A, 16B, FIG. 17, and FIG. 18 the radio terminal being practiced as a second preferred embodiment of the present invention.

The second embodiment of the radio terminal associated with the present invention will be described in detail with reference to each of the figures.

Figure 15A:
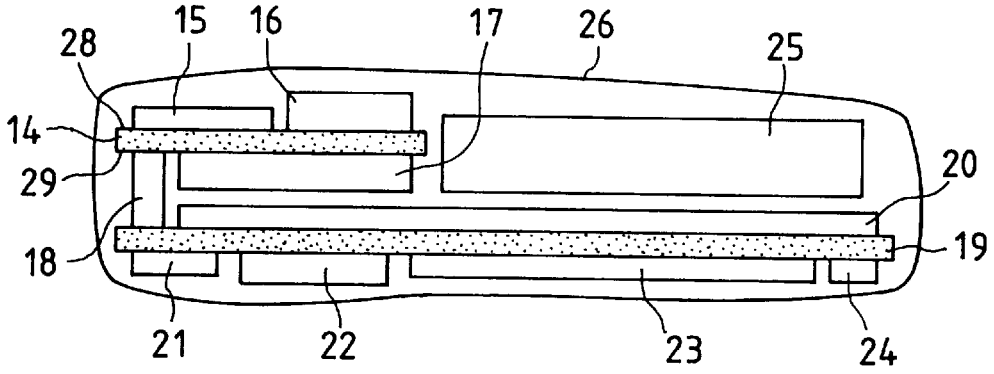
FIG. 15A is a cross section illustrating a radio terminal incorporating the coaxial resonant slot antenna according to the present invention, the radio terminal being practiced as a second preferred embodiment of the present invention.

FIG. 15A shows a cross section of the radio terminal of the second embodiment. A first main surface 28 of a radio frequency circuit board 14 is arranged with a coaxial resonant slot antenna 15 associated with the invention and one portion 16 of the radio frequency circuit near an antenna connecting point along the flow of a radio frequency signal. A second main surface 29 is arranged with another portion 17 of the radio frequency circuit far from the antenna connecting point along the flow of the radio frequency signal and a connector 18. A base band circuit board 19 is arranged with a base band circuit 20, a speaker 21, an LCD 22, a key pad 23, and a microphone 24. The radio frequency circuit board 14 and the base band circuit board 19 are interconnected with the connector 18 and accommodated in a casing 26 along with a battery 25, thereby constituting the radio terminal.

Figure 15B:
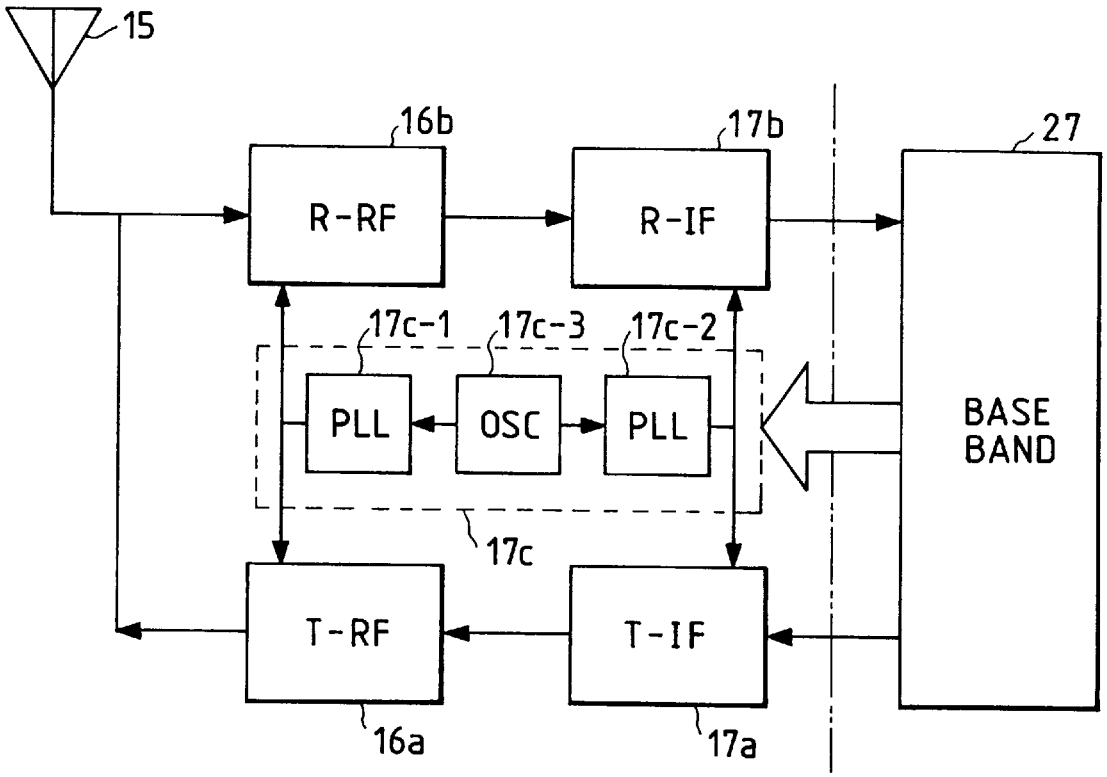
FIG. 15B is a circuit block diagram illustrating the radio terminal incorporating the coaxial resonant slot antenna according to the present invention, the radio terminal being practiced as the second preferred embodiment of the present invention.

FIG. 15B is a block diagram illustrating the radio terminal. The coaxial resonant slot antenna 15 is connected with a transmission circuit block 16*a* and a receiving circuit block 16*b* in parallel. The transmission circuit block 16*a* is connected with an intermediate-frequency block of transmission circuit 17*a* which is connected to a base band circuit block 27. The receiving circuit block 16*b* is connected with an intermediate-frequency block of receiving circuit 17*b* which is connected to the base band circuit block 27. The transmission circuit block 16*a* and the receiving circuit block 16*b* are connected with a first stage of PLL circuit 17*c*-1, an element circuit of a frequency synthesizer 17*c*. The intermediate-frequency block of transmission circuit 17*a* and the intermediate-frequency block of receiving circuit 17*b* are connected with a second stage of PLL circuit 17*c*-2, another element circuit of the frequency synthesizer 17*c*. The second stage of PLL circuit 17*c*-2 and the first stage of PLL circuit 17*c*-1 are connected with an original oscillator 17*c*-3, still another element circuit of the frequency synthesizer 17*c*. The frequency synthesizer 17*c* is supplied with a control signal from the base band circuit block 27. The height of the battery indispensable for the current radio terminal is 5 to 10 mm. The heights of the radio frequency components are 1 to 4 mm. The thickness of the radio frequency circuit board is about 1 mm. Consequently, if a double-sided radio frequency circuit board is used and arranged along the length of the battery and the radio terminal, the height of the battery and the thickness of the radio frequency circuit board mounted with components reach approximately the same level. According to the present embodiment, therefore, the circuit boards and the components can be densely packed in the casing of the radio terminal, thereby reducing the dimensions of the radio terminal.

Figure 16A:
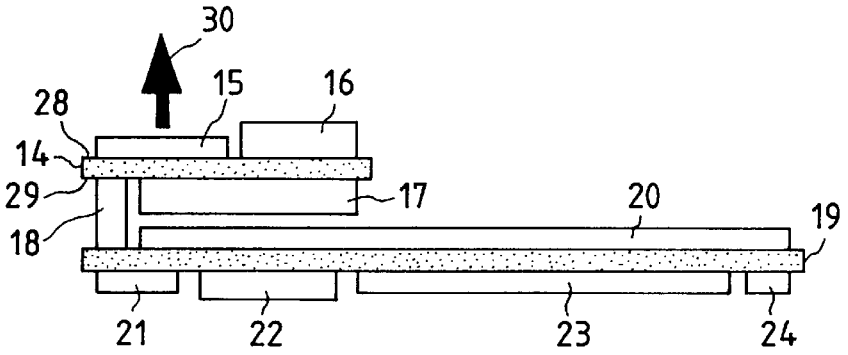
FIG. 16A is a cross section illustrating the radio terminal incorporating the coaxial resonant slot antenna according to the present invention, the radio terminal practiced as the second preferred embodiment of the present invention.
Figure 16B:
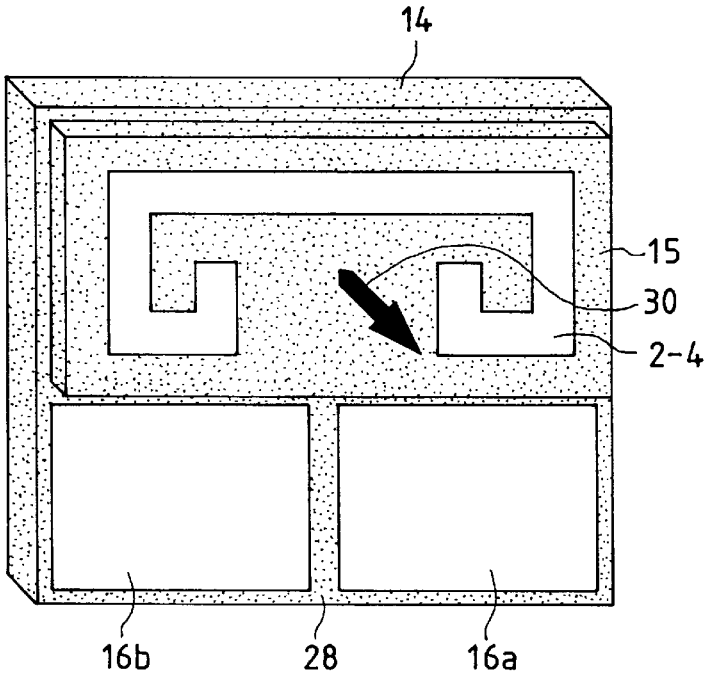
FIG. 16B is a perspective view illustrating a radio frequency circuit board for describing the radio terminal incorporating the coaxial resonant slot antenna according to the present invention, the radio terminal practiced as the second preferred embodiment of the present invention.

FIGS. 16A and 16B show a radiation pattern of the coaxial resonant slot antenna associated with the present invention as built in the radio terminal. FIG. 16A shows a cross section of the radio terminal with the casing 26 and the battery 25 not shown. FIG. 16B is a perspective view illustrating the radio frequency circuit board of the radio terminal. A coaxial resonant slot antenna 15 arranged on a first main surface 28 of the radio frequency circuit board 14 has uni-directivity in the direction 30 opposite to a second main surface 29. The first main surface 28 of the radio frequency circuit board 14 is arranged with the coaxial resonant slot antenna 15, a transmission circuit block 16*a*, and a receiving circuit block 16*b*. The coaxial resonant slot antenna 15 is provided with a slot 2-4 which operates as the antenna. This coaxial resonant slot antenna 15 has uni-directivity in the direction 30 perpendicular to the first main surface 28 and opposite to the second main surface 29.

According to the present embodiment, the electromagnetic wave radiated from the coaxial resonant slot antenna 15 in the direction of the second main surface 29 in which the operator of the radio terminal exists at the time of talking is suppressed, so that the electromagnetic wave interference by the electromagnetic wave radiated from the coaxial resonant slot antenna 15 against the circuit blocks on the second main surface 29 can be reduced. Further, the electromagnetic wave absorption by the operator at the time of talking is suppressed, so that the sensitivity of the radio terminal is enhanced. In addition, because the coaxial resonant slot antenna 15 is installed as one of the components of the radio frequency circuit board 14, flow and reflow soldering techniques, which are conventional parts packaging techniques, can be applied to reduce the number of antenna packaging processes as compared with a conventional outer antenna, thereby reducing the fabrication cost of the radio terminal.

Figure 17:
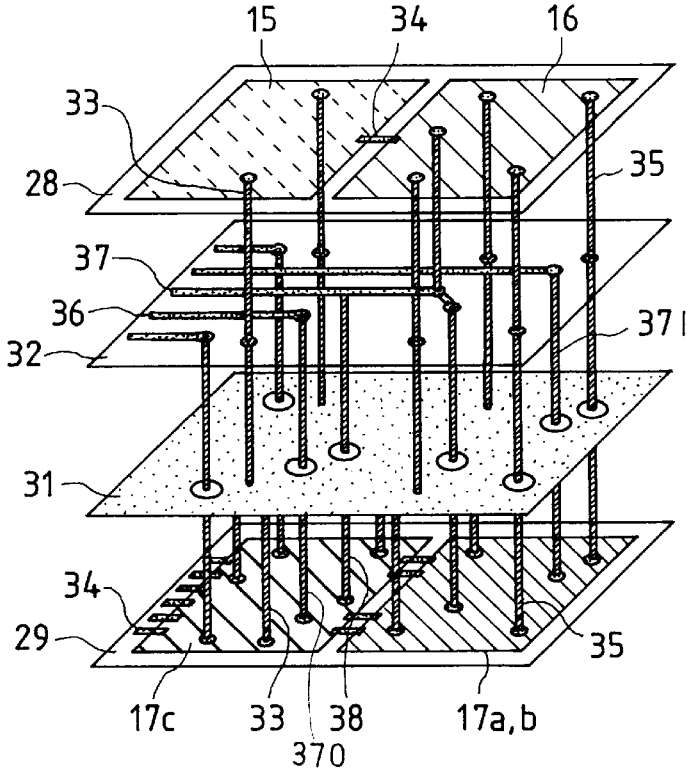
FIG. 17 is a perspective view illustrating a layer constitution of the radio frequency circuit board for describing the radio terminal incorporating the coaxial resonant slot antenna according to the present invention, the radio terminal being practiced as the second preferred embodiment of the present invention.

FIG. 17 shows a cross section of the radio frequency circuit board 14 in the second embodiment of the radio terminal. The radio frequency circuit board is composed of four layers. The first main surface 28 is arranged with the antenna 15 and the radio frequency circuit block 16. The second main surface 29 is arranged with the intermediate-frequency circuit block 17*a,* 17*b* and the frequency synthesizer 17*c*. Over the second main surface 29, a ground surface 31 is arranged. Between the ground surface 31 and the first main surface 28, the layer 32 of a power supply line and a control signal line is provided. Each circuit block is grounded to the ground surface 31 through a ground through-hole 33. Signal transfer between the circuit blocks is performed by a signal line 34 and a signal line through-hole 35. Transfer of control signals and supply of power to the circuit blocks are performed by a control signal line 36 and a control signal line through-hole 370, and a power supply line 37 and a power supply line through-hole 38. As described with reference to FIGS. 15A and 15B, of the circuit blocks arranged on the radio frequency circuit board 14, the frequency synthesizer 17*c* is supplied a lot of control signals. According to the present embodiment, the frequency synthesizer 17*c* is arranged at a position around the ground surface 31 of the radio frequency circuit board 14 and opposite to the antenna 15, so that the control signal line 36 supplied to the frequency synthesizer 17*c* is electromagnetically shielded by the ground conductor of the antenna 15 and the ground surface 31 of the radio frequency circuit board 14. Consequently, influence of the radiation of interference field of the radio frequency signal generated from the radio frequency signal line 34 formed on a portion of the surface layer except for a portion under the antenna 15 on the radio frequency circuit board 14 and the radio frequency component 16 arranged on that surface layer is significantly reduced, thereby enhancing the sensitivity of the radio terminal.

Figure 18:
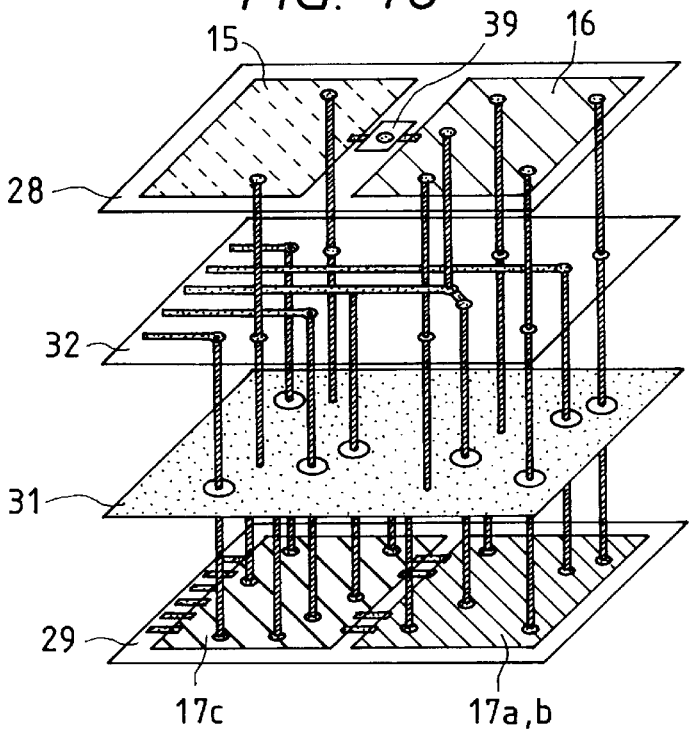
FIG. 18 is another perspective view illustrating the layer constitution of the radio frequency circuit board for describing the radio terminal incorporating the coaxial resonant slot antenna according to the present invention, the radio terminal being practiced as the second preferred embodiment of the present invention.

FIG. 18 shows another cross section of the radio frequency circuit board 14 in the second embodiment of the radio terminal. An antenna connector 39 is provided between the antenna 15 of the first main surface 28 of the radio frequency circuit board 14 and the radio frequency circuit block 16. The provision of the antenna connector 39 simplifies the inspection process, eventually reducing the cost of the radio terminal. According to the example of FIG. 18, the transmission power supplied from the radio frequency circuit 16 to the antenna 15 can be measured directly, in addition to the advantage provided by the example of FIG. 17, so that the number of measuring processes can be reduced and the measuring precision can be enhanced as compared with the transmission power measurement that uses a radio frequency coupler of some kind and its configuration value when the antenna connector 39 is not provided. This in turn simplifies the radio terminal characteristics adjusting process, reducing the cost of the radio terminal.

According to the second embodiment of the radio terminal, the antenna of the radio terminal can be built in the same by mounting the antenna as one component on the radio frequency circuit board to reduce the electromagnetic interference by the electromagnetic wave coming from the outside and other radio frequency circuit components against a particular radio frequency circuit components, especially the frequency synthesizer, thereby realizing the radio terminal small in size, high in sensitivity, and low in cost.

The following describes the radio terminal incorporating the coaxial resonant slot antenna associated with the present invention with reference to FIGS. 19 through 26, the radio terminal being practiced as a third preferred embodiment of the invention.

Building the coaxial resonant slot antenna formed on a single side thereof with a slot in the radio terminal can realize a small-sized, high-performance radio terminal.

The radiation characteristics of electromagnetic wave can be described by the electromagnetic field traversing the slot along the width thereof or the magnetic field orthogonal to that electromagnetic field on the upper surface of the conductive cubic. Since the magnetic field forms a positive image to the conductor surface, the electromagnetic wave has the peak in the directivity in the direction in which the magnetic field exists when viewed from the conductor surface and there is little radiation in the direction in which no magnetic field exists. Consequently, when the coaxial resonant slot antenna associated with the invention is installed with its rear side in contact with the surface of the casing of the radio terminal, little electromagnetic wave radiated from the slot is radiated to the casing side, so that the energy shift of the electromagnetic wave to the casing surface is suppressed, thereby suppressing the current to be induced on the casing surface.

Because the electromagnetic wave is intensely radiated to the outside direction vertical to the slot surface, arranging the antenna such that the radiation direction is opposite the operator's body, especially the operator's head, in the operating state, prevents the electromagnetic wave energy from being absorbed in the head, which occurs on conventional omni-directive antennas. This novel arrangement therefore enhances the sensitivity of the radio terminal at the time of talking and reduces the radiation of interference field to the operator's body.

On the other hand, when the radio terminal is used away from the operator's body in the standby mode or the like in the environment in which electromagnetic waves radiated from base stations and having a lot of multipaths come from unspecified directions in a premise or an urban area, talk may be disabled if a base station to communicate with exists in the direction in which the slot does not exist when viewed from the casing of the radio terminal.

Arranging coaxial resonant slot antennas associated with the present invention on the front plane and the rear plane and, for example, the side plane of the radio terminal with the plane of the radio terminal that the operator faces in talking or touched by the operator's ear for example being the front plane, driving all these antennas in the standby mode, and disconnecting the antenna installed on the front plane at talking allow the radio terminal to maintain a high sensitivity at talking and maintain an approximately uniform directivity at standby by the composite antennas.

Comparison in directivity between a radio terminal having composite directivity with a plurality of coaxial resonant slot antennas arranged and a radio terminal having omni-directivity is important in evaluating schemes of radio terminals using the coaxial resonant slot antenna associated with the present invention. Usually, since the direction in which a base station is unknown to the operator, it is reasonable to consider that the disability of communication with such a base station occurs stochastically from the relationship between the direction in which the operator is headed and the direction in which the base station exists.

For digital communication based on the above-mentioned assumptions, an electric power for obtaining the same bit error rate as that with an omni-directive antenna was obtained by calculation. The calculation was made in such a manner. Namely, directivity obtained by arranging a magnetic current element radiating electromagnetic wave at the center of a conductor plate serving as the casing vertically equivalent to ¼ of wavelength and laterally equivalent to ½ of wavelength is used as the reference pattern. Two, three, and four antennas are arranged point-symmetrically to synthesize directivities. The results of the calculation are shown in a graph of the FIG. 19. Increase in the electric power, namely a necessary gain rise is regarded as a loss, which is represented by the vertical axis of the graph of FIG. 19. The directivities of the antennas arranged as mentioned above are shown in FIG. 20 for one, two, and three antennas.

Figure 19:
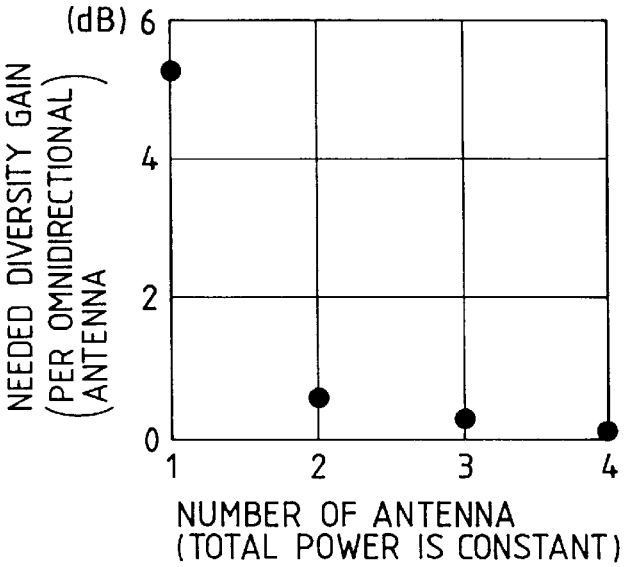
FIG. 19 is a diagram illustrating a degree of degradation obtained when one to four coaxial resonant slot antennas according to the present invention are arranged.

As shown in FIG. 19, as the number of antennas increases, the gain rise necessary for realizing the same sensitivity as that of an omni-directive antenna is suppressed quickly. Referring to FIG. 19, even if two directivities are synthesized, namely the antennas are arranged only on the front plane and the rear plane of the casing of the radio terminal, the necessary gain rise does not reach 1 dB. Therefore, arranging single-side directive antennas associated with the present invention on a plurality of planes of the casing or at least on the front and rear planes, driving all these antennas in the standby mode, and disconnecting the antenna arranged on the front plane can realize the same terminal sensitivity as that of a radio terminal equipped with a draw-out antenna or an outer antenna in the standby mode and implement a radio terminal of which sensitivity exceeds that of the above-mentioned radio terminal in the talk mode.

Figure 21:
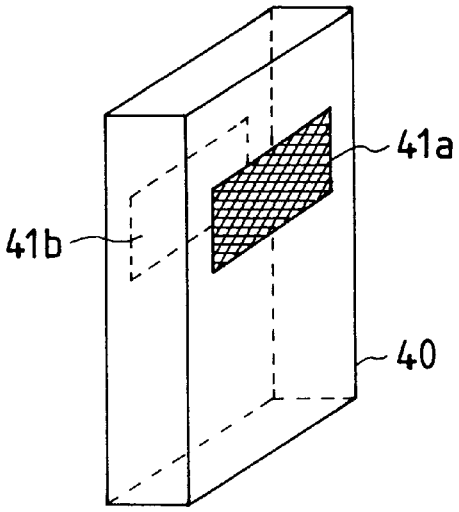
FIG. 21 is a schematic diagram illustrating a constitution of the radio terminal incorporating the coaxial resonant slot antenna according to the present invention, the radio terminal being practiced as a third preferred embodiment of the present invention.
Figure 22:
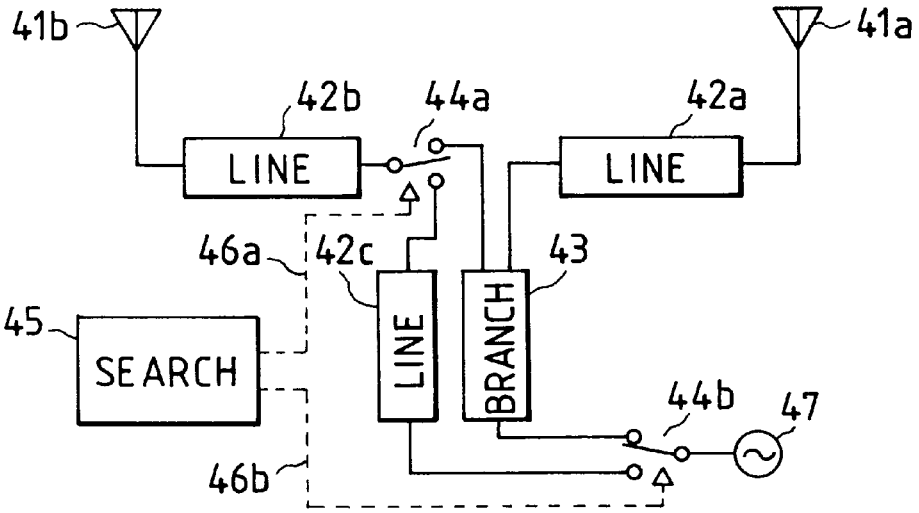
FIG. 22 is a circuit diagram illustrating an antenna connection of the radio terminal incorporating the coaxial resonant slot antenna according to the present invention, the radio terminal being practiced as the third preferred embodiment of the present invention.

FIG. 21 shows a constitution of a radio terminal incorporating two units of the coaxial resonant slot antennas associated with the present invention. FIG. 22 shows a diagram illustrating connections to the two coaxial resonant slot antennas. In FIG. 21, reference numeral 40 indicates a casing of the radio terminal, reference numeral 41*a* indicates a slot antenna arranged on the front plane of the casing 40, and reference numeral 41*b* indicates a slot antenna arranged on the rear plane of the casing 40. In FIG. 22, reference numerals 42*a*, 42*b*, and 42*c* indicate connection lines, reference numeral 43 indicates a divider, reference numerals 44*a* and 44*b* indicate switches, reference numeral 45 indicates a talk condition monitoring circuit, reference numerals 46*a* and 46*b* indicate control signal lines, and reference numeral 47 indicates a radio frequency circuit. The front plane is the plane of the casing that the operator faces or touches the operator's ear, while the rear plane is opposite to the front plane.

The antenna 41*a* is connected to one dividing end of the divider 43 via the connection line 42*a*. The antenna 41*b* is connected to a common contact of the switch 44*a* via the connection line 42*b*. The other dividing end of the divider 43 is connected to one switch contact of the switch 44*a*. The other switch contact of the switch 44*a* is connected with one end of the connection line 42*c*. The other end of the connection line 42*c* is connected to one switch contact of the switch 44*b*. The other switch contact of the switch 44*b* is connected to a common end of the divider 43. A common contact of the switch 44*b* is connected to the radio frequency circuit 47.

The talk condition monitoring circuit 45 controls the switches 44*a* and 44*b* via the control signals lines 46*a* and 46*b* respectively according to the talk state or the standby state. In the talk state, only the antenna 41*b* is connected to the radio frequency circuit via the divider 43. In the standby state, the antenna 41*a* and the antenna 41*b* are connected to the radio frequency circuit via the divider 43.

Figure 20:
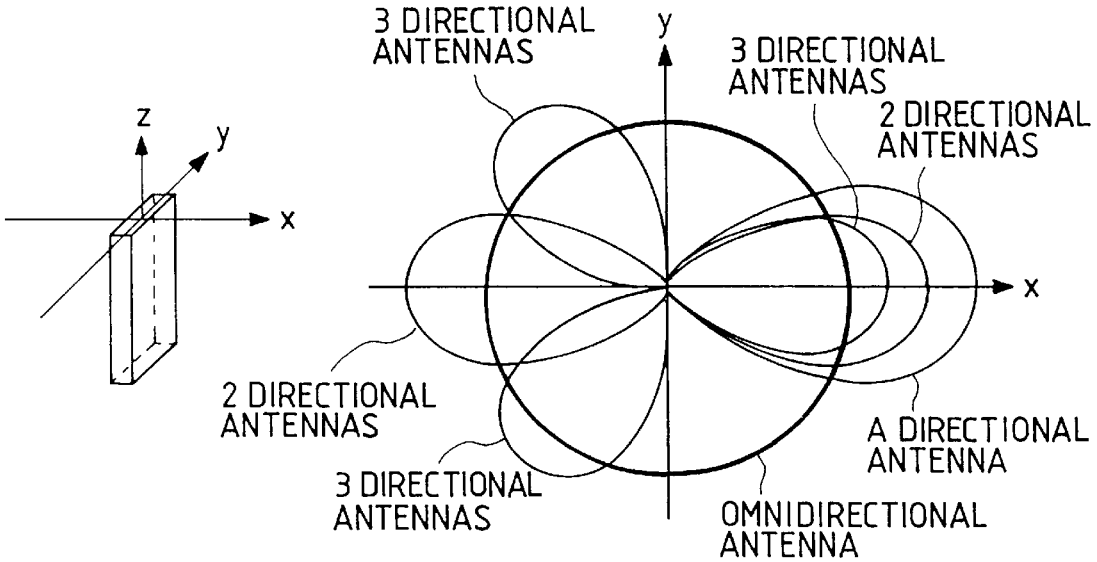
FIG. 20 is a diagram illustrating directional patterns obtained when one to three coaxial resonant slot antennas according to the present invention are arranged.

The antenna directivity in the standby state is that provided by the two antennas as shown in FIG. 20. The gain loss for the omni-directive antenna is limited to as small a value as about 0.6 dB as shown in FIG. 19. Thus the gain loss caused in the standby state is limited to a low level. In the talk state, the radiation of electromagnetic wave toward the operator's body, which is an absorber of high-frequency electromagnetic wave, is suppressed, so that, as compared with the omni-directive antenna, the antenna gain of the present embodiment rises when installed on a radio terminal, enhancing the sensitivity of the same.

Figure 23:
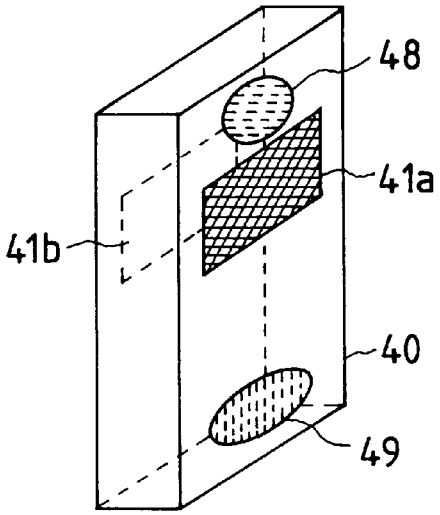
FIG. 23 is a schematic diagram illustrating the constitution of the radio terminal incorporating the coaxial resonant slot antenna according to the present invention, the radio terminal being practiced as the third preferred embodiment of the present invention.

FIG. 23 shows an example of the arrangement of an actual radio terminal. On the front plane 40, a speaker 48 and a microphone 49 are arranged. On the same plane, the antenna 41 is arranged. The antenna 41*b* is arranged on the rear plane. This arrangement necessarily directs the radio terminal such that the front plane faces the operator in the talk state, directing the antenna 41*b* in the opposite direction.

Figure 24:
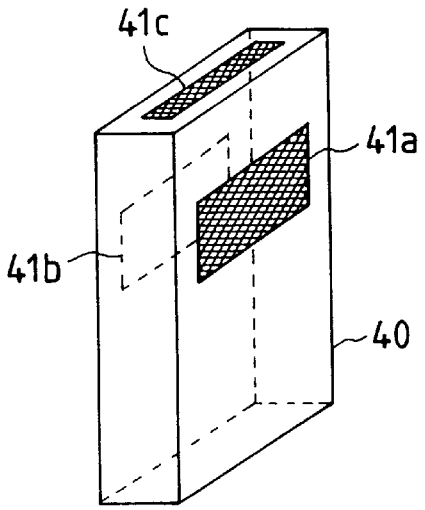
FIG. 24 is another schematic diagram illustrating the constitution of the radio terminal incorporating the coaxial resonant slot antenna according to the present invention, the radio terminal being practiced as the third preferred embodiment of the present invention.
Figure 25:
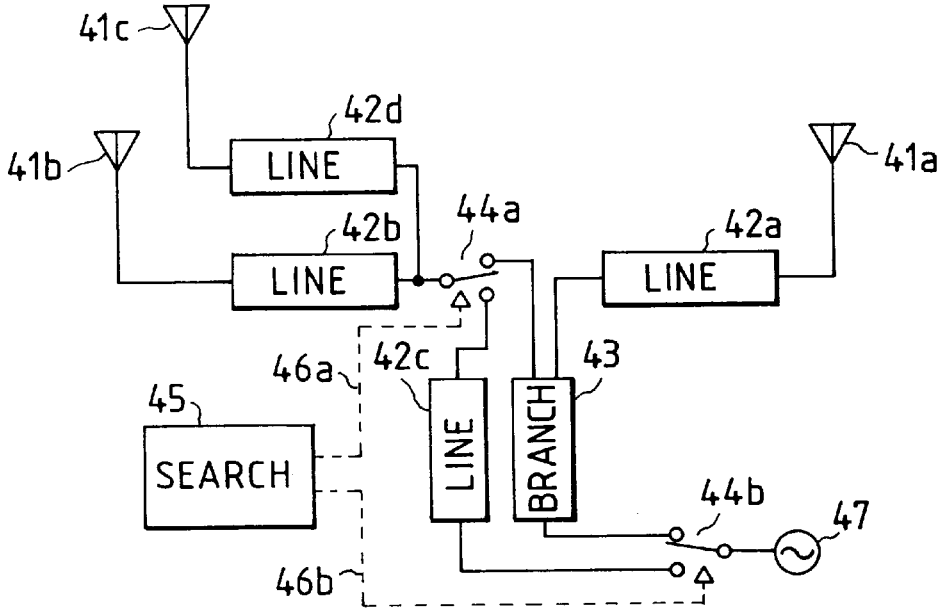
FIG. 25 is another circuit diagram illustrating an antenna connection of the radio terminal incorporating the coaxial resonant slot antenna according to the present invention, the radio terminal being practiced as the third preferred embodiment of the present invention.
Figure 27A:
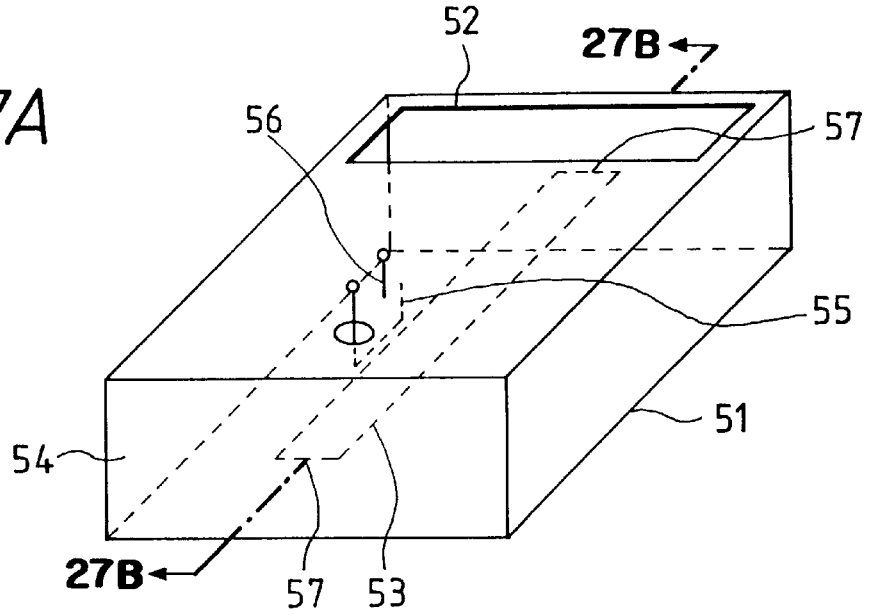
FIG. 27A is a perspective view illustrating a prior-art coaxial resonant slot antenna.
Figure 27B:
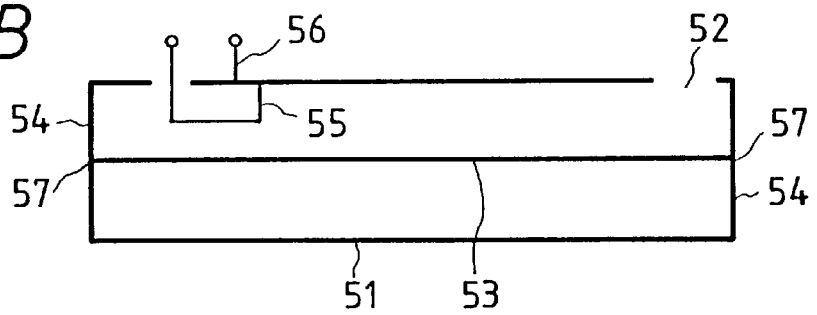
FIG. 27B is a cross section illustrating the prior-art coaxial resonant slot antenna.

FIG. 24 shows an example in which a third antenna 41*c* is arranged on the top plane of the casing 40, in addition to the antennas 41*a* and 41*b*. The antenna 41*c* is connected to the antenna 41*b*. This connection is shown in FIG. 25. The antenna 41*c* is connected, along with the antenna 41*b* to the common contact of the switch 44*a* via a connection line 42*d*. According to this constitution, the three antennas are driven in the standby state, so that the synthesized directivity of these three antenna approaches to omni-directivity further than the above-mentioned two-antenna constitution, further reducing the loss in the antenna sensitivity in the standby state.

Figure 26:
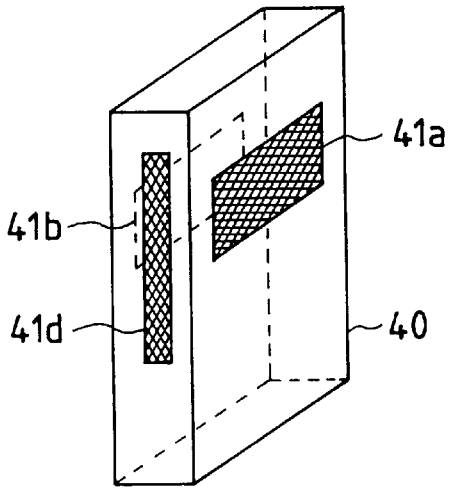
FIG. 26 is still another schematic diagram illustrating the constitution of the radio terminal incorporating the coaxial resonant slot antenna according to the present invention, the radio terminal being practiced as the third preferred embodiment of the present invention.

FIG. 26 shows an example in which the third antenna is arranged not on the top plane but on a side plane. As shown in the figure, reference numeral 41*d* indicates the third antenna thus arranged. As compared with the two-antenna constitution, the uniformity of the directivity in the plane vertical to the length of the casing 40 is enhanced, so that the loss in the sensitivity of the radio terminal in the standby state is reduced further.

According to the present invention, the flat-structured slot antenna having single-side directivity can be reduced in size significantly as compared with conventional counterpart. Consequently, the antenna according to the present invention is suitable for use as the built-in antenna in a radio terminal. The present invention facilitates the incorporation of a plurality of antennas in a radio terminal. When antennas according to the invention are arranged on a plurality of planes of the casing of a radio terminal, operating all installed antennas in the standby state and disconnecting the antenna facing the operation in the talk state allow to maintain the sensitivity of the radio terminal at generally the same level in the standby state as that of a conventional radio terminal incorporating an omni-directive antenna and enhance the sensitivity of the radio terminal having the antennas according to the invention in the talk state.

What is claimed is:

1. A coaxial resonant slot antenna comprising:

a conductive cubic having a shape of a rectangular prism;

a strip conductor having a length extending along a resonant axis of an inner space of said conductive cubic; and a slot for transmitting an electromagnetic wave, said slot being formed on one surface of said conductive cubic;

wherein said slot is composed of a first slot part having a length extending perpendicular to the resonant axis, two portions of a second slot part having a length extending parallel to the resonant axis and two portions of a third slot part having a length extending perpendicular to the resonant axis and which is shorter in length than the first slot part, each of ends of the first slot part, second slot part, an third slot part and the portions thereof being connected continuously in an order of third, second, first, second, third, the first slot part being arranged crossing said strip conductor; and wherein said strip conductor is arranged, in its entirety, as insulated from said conductive cubic.

2. A coaxial resonant slot antenna according to claim 1, wherein a total length of said slot from one end thereof to the other is equivalent to about ½ of wavelength.

3. A coaxial resonant slot antenna according to claim 1, wherein said conductive cubic is filled inside thereof with a dielectric material.

4. A coaxial resonant slot antenna according to claim 1, wherein said conductive cubic is filled inside thereof with a magnetic material having a conductivity that is low enough for mitigating decrease in Q-value of resonation.

5. A coaxial resonant slot antenna according to claim 1, wherein said conductive cubic is divided into two spaces by a plane provided by a front surface of said strip conductor, one of the spaces opposite to a front surface on which said slot is formed being filled with a dielectric material, said dielectric material is formed on the front surface thereof with said strip conductor.

6. A coaxial resonant slot antenna according to claim 1, further comprising:

a two-layer insulation board composed of an upper planar insulator and a lower planar insulator;

wherein conductive cubic is composed of a first metallic film having said slot fromed on a front surface of said upper planar insulator, a second metallic film formed on said lower planar insulator on the rear surface thereof as opposed against said first metallic film, and a plurality of metallized through-holes formed through peripheries of said upper planer insulator and said lower planar insulator to electrically connect said first metallic film to said second metallic film;

wherein said strip conductor is composed of a third metallic film formed between said upper planar insulator and said lower planar insulator.

7. A coaxial resonant slot antenna according to claim 1, wherein said conductive cubic is a box-like member having outer surfaces, all of the outer surfaces being conductive, and the two portions of the third slot part extending from the two portions of the second slot part in a direction toward said strip conductor.

8. A coaxial resonant slot antenna according to claim 1, wherein the length of the third slot part is shorter than the half of the length of the first slot part, and the second slot part and third slot part are arranged not to overlap said strip conductor.

9. A radio terminal incorporating a multilayer circuit board having n stripline layers, comprising:

a radio frequency component arranged on a first layer or a n-th layer or both of said multilayer circuit board;

a first stripline pattern formed on a m-th layer of said multilayer circuit board, wherein $1 \leqq m \leqq n-2$;

a second stripline pattern formed on a position opposed to said first stripline pattern of a p-th layer of said multilayer circuit board wherein $3 \leqq p \leqq n$ and $p \leqq m+2$, said second stripline pattern having generally the same shape as that of said first stripline pattern;

a stripline conductor shaped in a strip formed at a position between said first stripline pattern and said second stripline pattern on o-th layer of said multilayer circuit board, wherein $m<o<p$;

a plurality of first through-holes parallel to each other formed around said stripline conductor for electrically connecting an outer periphery of said first stripline pattern to an outer periphery of said second stripline pattern; and a slot formed on said first stripline pattern such that said slot crosses said stripline conductor;

wherein said stripline conductor is not in electrical contact with one of said first stripline pattern, said second stripline pattern, and said plurality of first through-holes, said radio frequency component is electrically connected to said stripline conductor, and one of said first stripline pattern, said second stripline pattern, and said plurality of first through-holes is connected to a ground conductor provided on one of a second layer to n-1-th layer.

10. The radio terminal incorporating a multilayer circuit board having n stripline layers according to claim 9, wherein said multilayer circuit board is arranged inside a casing of said radio terminal such that a direction of radiation of an electromagnetic wave coming from said slot is generally opposite to operator's head in talk state.

11. The radio terminal incorporating a multilayer circuit board having n stripline layers according to claim 9, wherein a total length of said slot from one end thereof to the other is equivalent to about ½ of wavelength of said radio terminal, a portion of said slot crossing said stripline conductor is in the proximity of one end of said stripline conductor, and a portion of said stripline conductor electrically connected to said radio frequency component is at a position equivalent to about ¼ of wavelength of said radio terminal from said one end of said stripline conductor.

12. The radio terminal incorporating a multilayer circuit board having n stripline layers according to claim 11, wherein no radio frequency component is arranged at a position opposed to said slot on said first layer of said multilayer circuit board.

13. A radio terminal incorporating a multilayer circuit board in a casing of said radio terminal, comprising:

a coaxial resonant slot antenna arranged on a first main surface of said multilayer circuit board;

a first radio frequency circuit located near a connecting point of said coaxial resonant slot antenna arranged on said first main surface;

a second radio frequency circuit located far from a connecting point of said coaxial resonant slot antenna arranged on a second main surface of said multilayer circuit board opposite to said first main surface; and a frequency synthesizer arranged at a position opposite to said coaxial resonant slot antenna on said second main surface;

said coaxial resonant slot antenna comprising:

a conductive cubic which is a rectangular prism in overall shape;

a strip conductor narrow in shape arranged along the resonance axis of the inner space of said conductive cubic; and an electromagnetic wave send/receive slot formed on a front surface of said conductive cubic such that said slot crosses said strip conductor;

wherein said coaxial resonant slot antenna is arranged on said multilayer circuit board such that a rear surface of said conductive cubic comes in contact with said first main surface, said coaxial resonant slot antenna having uni-directivity in the direction opposite to said second main surface, said strip conductor in its entirety is insulated from said conductive cubic and a connection point of said strip conductor to said first radio frequency circuit is arranged at a position equivalent to about ¼ of wavelength of said radio terminal away from one end of said strip conductor, and one of stripline layers in said multilayer circuit board is used as a ground layer, said conductive cubic is connected to said ground layer via a through-hole, a control signal line is formed on a stripline layer between said ground layer and the rear surface of said conductive cubic, and said frequency synthesizer is electrically connected to said control signal line via a through-hole.

14. The radio terminal incorporating a multilayer circuit board in a casing of said radio terminal according to claim 13, further comprising:

an antenna connector arranged on said first main surface of said multilayer circuit board;

wherein said strip conductor of said coaxial resonant slot antenna is electrically connected to said first radio frequency circuit via said antenna connector.

15. A radio terminal incorporating a coaxial resonant slot antenna, comprising:

a speaker and a microphone arranged at positions in the proximity of a rear surface of a casing of said radio terminal facing an operator in a talking state;

a first coaxial resonant slot antenna having a single-side pattern arranged at a position in the proximity of the rear surface of the casing of said radio terminal facing the direction opposite to the operator in the talking state, said first coaxial resonant slot antenna in the talking state, radiating an electromagnetic wave in a direction approximately opposite to the operator;

monitoring means for monitoring whether said radio terminal is in the talking state or a standby state; and a second coaxial resonant slot antenna arranged at a position in the proximity of a front surface of the casing of said radio terminal facing the operator in the talking state;

wherein, if said radio terminal is determined to be in the talking state by said monitoring means, only said first coaxial resonant slot antenna is driven and, if said radio terminal is determined to be in the standby state by said monitoring means, both said first coaxial resonant slot antenna and said second coaxial slot antenna are driven.

16. A coaxial resonant slot antenna comprising:

a conductive cubic having a shape of a rectangular prism in shape;

a strip conductor having a length extending along a resonant axis of an inner space of said conductive cubic; and a slot for transmitting and receiving an electromagnetic wave, said slot being formed on one surface of said conductive cubic;

wherein said slot is composed of a first slot part having a length extending perpendicular to the resonant axis, two portions of a second slot part having a length extending parallel to the resonant axis, two portions of a third slot part having a length extending perpendicular to the resonant axis and which is shorter in length than the first slot part, and two portions of a fourth slot part having a length extending parallel to the resonant axis and which is shorter in length than the second slot part, each of ends of the first slot part, second slot part, third slot part, and fourth slot part and the portions thereof being connected continuously in an order of fourth, third, second, first, second, third, fourth, the first slot part being arranged crossing said strip conductor; and wherein said strip conductor is arranged, in its entirety, as insulated from said conductive cubic.

17. A coaxial resonant slot antenna according to claim 16, wherein conductive cubic is a box-like member having outer surfaces, all of the outer surfaces being conductive, and the two portions of the third slot part extending from the two portions of the second slot part in a direction toward said strip conductor, the two portions of the fourth slot part extending from the two portions of the third slot part in a direction toward the first slot part.

18. A coaxial resonant slot antenna according to claim 16, wherein a total length of said slot from one end thereof to the other is equivalent to about ½ of wavelength.

19. A coaxial resonant slot antenna according to claim 16, wherein said conductive cubic has the inside thereof filled with a dielectric material.

20. A coaxial resonant slot antenna according to claim 16, wherein the length of the third slot part is shorter than the half of the length of the first slot part, and the second slot part, third slot part, and fourth slot part are arranged not to overlap said strip conductor.

* * * * *